US009224338B2

(12) United States Patent
Chan et al.

(10) Patent No.: US 9,224,338 B2
(45) Date of Patent: Dec. 29, 2015

(54) DRIVING METHODS FOR ELECTROPHORETIC DISPLAYS

(75) Inventors: Bryan Hans Chan, San Francisco, CA (US); Craig Lin, San Jose, CA (US)

(73) Assignee: E INK CALIFORNIA, LLC, Fremont, CA (US)

( * ) Notice: Subject to any disclaimer, the term of this patent is extended or adjusted under 35 U.S.C. 154(b) by 1092 days.

(21) Appl. No.: 13/041,277

(22) Filed: Mar. 4, 2011

(65) Prior Publication Data

US 2011/0216104 A1 Sep. 8, 2011

Related U.S. Application Data

(60) Provisional application No. 61/311,693, filed on Mar. 8, 2010.

(51) Int. Cl.
*G09G 3/34* (2006.01)
*G09G 5/10* (2006.01)

(52) U.S. Cl.
CPC ... *G09G 3/34* (2013.01); *G09G 5/10* (2013.01)

(58) Field of Classification Search
CPC ..... G09G 3/344; G09G 2310/068
USPC ..... 345/53, 107, 208, 690
See application file for complete search history.

(56) References Cited

U.S. PATENT DOCUMENTS

| | | | |
|---|---|---|---|
| 4,143,947 | A | 3/1979 | Aftergut et al. |
| 4,259,694 | A | 3/1981 | Liao |
| 4,443,108 | A | 4/1984 | Webster |
| 4,568,975 | A | 2/1986 | Harshbarger et al. |
| 4,575,124 | A | 3/1986 | Morrison et al. |
| 5,266,937 | A | 11/1993 | DiSanto et al. |
| 5,298,993 | A | 3/1994 | Edgar et al. |
| 5,754,584 | A | 5/1998 | Durrant et al. |
| 5,831,697 | A | 11/1998 | Evanicky et al. |
| 5,923,315 | A | 7/1999 | Ueda et al. |
| 5,926,617 | A | 7/1999 | Ohara et al. |
| 6,005,890 | A | 12/1999 | Clow et al. |
| 6,045,756 | A | 4/2000 | Carr et al. |
| 6,069,971 | A | 5/2000 | Kanno et al. |

(Continued)

FOREIGN PATENT DOCUMENTS

| | | | |
|---|---|---|---|
| CN | 1813279 | A | 8/2006 |
| CN | 1849639 | A | 10/2006 |

(Continued)

OTHER PUBLICATIONS

Sprague, R.A. (May 18, 2011) *Active Matrix Displays for e-Readers Using Microcup Electrophoretics.* Presentation conducted at SID 2011, 49 Int'l Symposium, Seminar and Exhibition, May 15-May 20, 2011, Los Angeles Convention Center, Los Angeles, CA, USA.
U.S. Appl. No. 12/046,197, filed Mar. 11, 2008, Wang et al.
U.S. Appl. No. 12/115,513, filed May 5, 2008, Sprague et al.
U.S. Appl. No. 12/909,752, filed Oct. 21, 2010, Sprague et al.
U.S. Appl. No. 13/004,763, filed Jan. 11, 2011, Lin et al.
U.S. Appl. No. 13/009,711, filed Jan. 19, 2011, Lin.
Kao, WC., . (Feb. 2009) Configurable Timing Controller Design for Active Matrix Electrophoretic Dispaly. *IEEE Transactions on Consumer Electronics,* 2009, vol. 55, Issue 1, pp. 1-5.

(Continued)

*Primary Examiner* — Carolyn R Edwards
(74) *Attorney, Agent, or Firm* — Perkins Coie LLP; Viola T. Kung

(57) ABSTRACT

The driving system and methods of the present invention enable interruption of updating images. The system and methods have the advantage that they not only can speed up the updating process when more than one command is received consecutively in a short period of time, but also can provide a more smooth transition visually during the updating process.

6 Claims, 19 Drawing Sheets

(56) References Cited

U.S. PATENT DOCUMENTS

| | | | | |
|---|---|---|---|---|
| 6,075,506 | A | 6/2000 | Bonnett et al. | |
| 6,111,248 | A | 8/2000 | Melendez et al. | |
| 6,154,309 | A | 11/2000 | Otani et al. | |
| 6,473,072 | B1 | 10/2002 | Comiskey et al. | |
| 6,504,524 | B1 | 1/2003 | Gates et al. | |
| 6,531,997 | B1 | 3/2003 | Gates et al. | |
| 6,532,008 | B1 | 3/2003 | Guranlnick | |
| 6,639,580 | B1 | 10/2003 | Kishi et al. | |
| 6,657,612 | B2 | 12/2003 | Machida et al. | |
| 6,671,081 | B2 | 12/2003 | Kawai | |
| 6,674,561 | B2 | 1/2004 | Ohnishi et al. | |
| 6,686,953 | B1 | 2/2004 | Holmes | |
| 6,796,698 | B2 | 9/2004 | Sommers et al. | |
| 6,903,716 | B2 | 6/2005 | Kawabe et al. | |
| 6,914,713 | B2 | 7/2005 | Chung et al. | |
| 6,927,755 | B2 | 8/2005 | Chang | |
| 6,970,155 | B2 | 11/2005 | Cabrera | |
| 6,982,178 | B2 | 1/2006 | LeCain et al. | |
| 6,987,503 | B2 | 1/2006 | Inoue | |
| 6,995,550 | B2 | 2/2006 | Jacobson et al. | |
| 7,119,772 | B2 | 10/2006 | Amundson et al. | |
| 7,177,066 | B2 | 2/2007 | Chung et al. | |
| 7,184,196 | B2 | 2/2007 | Ukigaya | |
| 7,202,847 | B2 | 4/2007 | Gates | |
| 7,242,514 | B2 | 7/2007 | Chung et al. | |
| 7,277,074 | B2 | 10/2007 | Shih | |
| 7,283,119 | B2 | 10/2007 | Kishi | |
| 7,307,779 | B1 | 12/2007 | Cernasov et al. | |
| 7,312,794 | B2 | 12/2007 | Zehner et al. | |
| 7,349,146 | B1 | 3/2008 | Douglass et al. | |
| 7,504,050 | B2 | 3/2009 | Weng et al. | |
| 7,528,822 | B2 | 5/2009 | Amundson et al. | |
| 7,705,823 | B2 | 4/2010 | Nihei et al. | |
| 7,710,376 | B2 | 5/2010 | Edo et al. | |
| 7,733,311 | B2 | 6/2010 | Amundson et al. | |
| 7,773,069 | B2 | 8/2010 | Miyasaka et al. | |
| 7,786,974 | B2 | 8/2010 | Zhou et al. | |
| 7,800,580 | B2 | 9/2010 | Johnson et al. | |
| 7,804,483 | B2 | 9/2010 | Zhou et al. | |
| 7,816,440 | B2 | 10/2010 | Matsui | |
| 7,839,381 | B2 | 11/2010 | Zhou et al. | |
| 7,952,558 | B2 | 5/2011 | Yang et al. | |
| 7,999,787 | B2 | 8/2011 | Amundson et al. | |
| 8,009,348 | B2 | 8/2011 | Zehner et al. | |
| 8,035,611 | B2 | 10/2011 | Sakamoto | |
| 8,044,927 | B2 | 10/2011 | Inoue | |
| 8,054,253 | B2 | 11/2011 | Yoo | |
| 8,102,363 | B2 | 1/2012 | Hirayama | |
| 8,179,387 | B2 | 5/2012 | Shin et al. | |
| 8,237,733 | B2 * | 8/2012 | Rhodes | 345/589 |
| 8,334,836 | B2 | 12/2012 | Kanamori et al. | |
| 8,405,600 | B2 | 3/2013 | Reis et al. | |
| 8,576,163 | B2 | 11/2013 | Miyazaki et al. | |
| 8,704,753 | B2 | 4/2014 | Miyazaki et al. | |
| 2002/0021483 | A1 | 2/2002 | Katase | |
| 2002/0033792 | A1 | 3/2002 | Inoue | |
| 2003/0095090 | A1 | 5/2003 | Ham | |
| 2003/0137521 | A1 | 7/2003 | Zehner et al. | |
| 2003/0193565 | A1 | 10/2003 | Wen et al. | |
| 2004/0227746 | A1 | 11/2004 | Shih | |
| 2004/0246562 | A1 | 12/2004 | Chung et al. | |
| 2004/0263450 | A1 | 12/2004 | Lee et al. | |
| 2005/0001812 | A1 * | 1/2005 | Amundson et al. | 345/107 |
| 2005/0162377 | A1 | 7/2005 | Zhou et al. | |
| 2005/0179642 | A1 | 8/2005 | Wilcox et al. | |
| 2005/0185003 | A1 | 8/2005 | Dedene et al. | |
| 2005/0210405 | A1 | 9/2005 | Ernst et al. | |
| 2005/0219184 | A1 * | 10/2005 | Zehner et al. | 345/89 |
| 2006/0023126 | A1 | 2/2006 | Johnson et al. | |
| 2006/0050361 | A1 | 3/2006 | Johnson | |
| 2006/0119567 | A1 | 6/2006 | Zhou et al. | |
| 2006/0132426 | A1 | 6/2006 | Johnson | |
| 2006/0139305 | A1 | 6/2006 | Zhou et al. | |
| 2006/0139309 | A1 | 6/2006 | Miyasaka | |
| 2006/0164405 | A1 * | 7/2006 | Zhou | 345/204 |
| 2006/0187186 | A1 | 8/2006 | Zhou et al. | |
| 2006/0192751 | A1 | 8/2006 | Miyasaka et al. | |
| 2006/0232547 | A1 | 10/2006 | Johnson et al. | |
| 2006/0262147 | A1 | 11/2006 | Kimpe et al. | |
| 2007/0035510 | A1 | 2/2007 | Zhou et al. | |
| 2007/0046621 | A1 | 3/2007 | Suwabe et al. | |
| 2007/0046625 | A1 | 3/2007 | Yee | |
| 2007/0052668 | A1 | 3/2007 | Zhou et al. | |
| 2007/0070032 | A1 | 3/2007 | Chung et al. | |
| 2007/0080926 | A1 | 4/2007 | Zhou et al. | |
| 2007/0080928 | A1 | 4/2007 | Ishii et al. | |
| 2007/0091117 | A1 | 4/2007 | Zhou et al. | |
| 2007/0103427 | A1 | 5/2007 | Zhou et al. | |
| 2007/0109274 | A1 | 5/2007 | Reynolds | |
| 2007/0132687 | A1 | 6/2007 | Johnson | |
| 2007/0146306 | A1 | 6/2007 | Johnson et al. | |
| 2007/0159682 | A1 | 7/2007 | Takanak et al. | |
| 2007/0176889 | A1 * | 8/2007 | Zhou et al. | 345/107 |
| 2007/0182402 | A1 | 8/2007 | Kojima | |
| 2007/0188439 | A1 | 8/2007 | Kimura et al. | |
| 2007/0200874 | A1 | 8/2007 | Amundson et al. | |
| 2007/0247417 | A1 | 10/2007 | Miyazaki et al. | |
| 2007/0262949 | A1 | 11/2007 | Zhou et al. | |
| 2007/0276615 | A1 | 11/2007 | Cao et al. | |
| 2007/0296690 | A1 | 12/2007 | Nagasaki | |
| 2008/0150886 | A1 | 6/2008 | Johnson et al. | |
| 2008/0158142 | A1 | 7/2008 | Zhou et al. | |
| 2008/0211833 | A1 | 9/2008 | Inoue | |
| 2008/0266243 | A1 | 10/2008 | Johnson et al. | |
| 2008/0273022 | A1 | 11/2008 | Komatsu | |
| 2008/0303780 | A1 * | 12/2008 | Sprague et al. | 345/107 |
| 2008/0309612 | A1 * | 12/2008 | Gormish et al. | 345/105 |
| 2009/0046114 | A1 * | 2/2009 | Lee et al. | 345/691 |
| 2009/0096745 | A1 | 4/2009 | Sprague et al. | |
| 2009/0256868 | A1 * | 10/2009 | Low et al. | 345/691 |
| 2009/0267970 | A1 * | 10/2009 | Wong et al. | 345/690 |
| 2010/0134538 | A1 | 6/2010 | Sprague et al. | |
| 2010/0149169 | A1 | 6/2010 | Miyasaka | |
| 2010/0194733 | A1 | 8/2010 | Lin et al. | |
| 2010/0194789 | A1 | 8/2010 | Lin et al. | |
| 2010/0238203 | A1 | 9/2010 | Stroemer et al. | |
| 2010/0283804 | A1 | 11/2010 | Sprague et al. | |
| 2010/0295880 | A1 | 11/2010 | Sprague et al. | |
| 2011/0216104 | A1 | 9/2011 | Chan et al. | |
| 2011/0298776 | A1 | 12/2011 | Lin | |
| 2012/0120122 | A1 | 5/2012 | Lin et al. | |
| 2012/0274671 | A1 | 11/2012 | Sprague et al. | |
| 2012/0320017 | A1 | 12/2012 | Sprague et al. | |

FOREIGN PATENT DOCUMENTS

| | | | |
|---|---|---|---|
| CN | 101009083 | A | 8/2007 |
| CN | 101236727 | | 8/2008 |
| JP | 2002-14654 | A | 1/2002 |
| JP | 2009192786 | | 8/2009 |
| KR | 10-2008-0055331 | | 6/2008 |
| TW | 200506783 | | 2/2005 |
| TW | 200625223 | | 7/2006 |
| WO | WO 2005/004099 | | 1/2005 |
| WO | WO 2005/031688 | | 4/2005 |
| WO | WO 2005/034076 | | 4/2005 |
| WO | WO 2009/049204 | | 4/2009 |
| WO | WO 2010/132272 | | 11/2010 |

OTHER PUBLICATIONS

Kao, WC., Fang, CY., Chen, YY., Shen, MH., and Wong, J. (Jan. 2008) Integrating Flexible Electrophoretic Display and One-Time Password Generator in Smart Cards. *ICCE 2008 Digest of Technical Papers,* p. 4-3. (Int'l Conference on Consumer Electronics, Jan. 9-13, 2008).

Kao, WC., Ye, JA., Lin, FS., Lin, C., and Sprague, R. (Jan. 2009) Configurable Timing Controller Design for Active Matrix Electrophoretic Display with 16 Gray Levels. *ICCE 2009 Digest of Technical Papers,* 10.2-2.

* cited by examiner

T=240 msec

DRIVING METHODS FOR ELECTROPHORETIC DISPLAYS

This application claims the benefit of U.S. Provisional Application No. 61/311,693, filed Mar. 8, 2010, which is incorporated herein by reference in its entirety.

TECHNICAL FIELD

The present invention relates to a driving system and methods for an electrophoretic display.

BACKGROUND OF THE INVENTION

An electrophoretic display (EPD) is a non-emissive device based on the electrophoresis phenomenon of charged pigment particles suspended in a solvent. The display usually comprises two plates with electrodes placed opposing each other and one of the electrodes is transparent. A suspension composed of a colored solvent and charged pigment particles dispersed therein is enclosed between the two plates. When a voltage difference is imposed between the two electrodes, the pigment particles migrate to one side or the other, causing either the color of the pigment particles or the color of the solvent to be seen, depending on the polarity of the voltage difference.

In order to obtain a desired image, driving waveforms are required for an electrophoretic display. A driving waveform consists of a series of voltages applied to each pixel to allow migration of the pigment particles in the electrophoretic fluid.

In the current driving system, when an image is to be updated, the display controller in the system compares the current image and the next image, finds appropriate waveforms in a look-up table and then sends the selected waveforms to the display to drive the current image to the next image. However, if after the command to drive the current image to the next image is received and before the updating is complete, there is a new command to update to a different desired image, this second command, however, does not automatically override the first command. This is due to the fact that after the selected waveforms have been sent to the display, the waveforms must be completed before a new command can be executed. In other words, the current driving system is not interruptible. In light of this shortcoming that updating of images could be slowed down when interruption occurs, the current method is particularly undesirable in a situation where user interaction with an electronic device (such as an e-book) is an essential feature.

SUMMARY OF THE INVENTION

The first aspect of the present invention is directed to a driving method for continuously updating multiple images utilizing phase A which drives pixels of a first color to a second color and phase B which drives pixels of the second color to the first color, which method comprises the following steps:

a) completing a phase A to update a current image to an intermediate state image, in response to an initial command to update the current image to a first next image; and b) completing a phase B to update the intermediate state image to a second next image, in response to a second command received in the phase A to update to the second next image.

In one embodiment, in step (a), a display controller, in response to an initial command to update a current image to a first next image, compares the current image and the first next image, finds proper waveforms and sends the waveforms to the display to update the current image to the first next image.

In one embodiment, in step (b), the display controller, in response to a second command to update to a second next image, compares the intermediate state image and the second next image, finds proper waveforms and sends the waveforms to the display to update to the second next image.

In one embodiment, there may be one or more interrupting commands in the phase A in step (a).

In one embodiment, there may be one or more interrupting commands in the phase B in step (b).

The second aspect of the present invention is directed to a driving method for continuously updating multiple images utilizing phase A which drives pixels of a first color to a second color and phase B which drives pixels of the second color to the first color, which method comprises the following steps:

a) completing a first phase A to update a current image to an intermediate state image, in response to an initial command to update the current image to a first next image;

b) partially completing a first phase B to update to a transition image and terminating the first phase B, in response to a second command to update to a second next image which command is received in the first phase B;

c) starting a second phase A at an appropriate frame and completing the second phase A to update to a second intermediate state image; and d) completing a second phase B to update to the second next image.

In one embodiment, in steps (a) and (b), a display controller, in response to an initial command to update a current image to a first next image, compares the current image and the first next image, finds proper waveforms and sends the waveforms to the display to update the current image to the first next image.

In one embodiment, in step (c), a counter determines how many frames ("n") have been completed in phase B in the previous step and a second phase A is started at the frame N−n+1 wherein N is the number of frames in each of phase A and phase B.

In one embodiment, in step (c), after the second phase A is completed, the display controller compares an intermediate state image and a second next image, selects appropriate waveforms and sends the waveforms to the display to update to the second next image in step (d).

In one embodiment, there is only one interrupting command which is received in the phase B in step (b).

In one embodiment, there is more than one interrupting command in the phase B in step (b).

Alternatively, this second aspect of the invention may be carried out in the following manner:

a) completing a first phase A to update a current image to an intermediate state image, in response to an initial command to update the current image to a first next image;

b) partially completing a first phase B to update to a transition image and terminating the first phase B, in response to a second command to update to a second next image which command is received in the first phase B;

c) completing a second phase B to update the transition image to a second transition image; and d) starting a second phase A at an appropriate frame and completing the second phase A to update the second transition image to the second next image.

The driving system and methods of the present invention enable interruption of updating images. The system and methods have the advantage that they not only can speed up the updating process when more than one command is received consecutively in a short period of time, but also can provide a more smooth transition visually during the updating process.

DETAILED DESCRIPTION OF THE INVENTION

The terms, "first" and "second" color states, are intended to refer to any two contrast colors. While the black and white colors are specifically referred to in illustrating the present invention, it is understood that the present invention is applicable to any two contrast colors in a binary color system.

The terms, "current" and "next" images referred to, throughout the present application, are two consecutive images and a "current image" is to be updated to a "next image" by a driving method.

When a "current" image is being updated to a "next" image, before updating of the "current" image to the "next" image is completed, there may be a second command to update to another image (which is different from the "next" image). In this case, the two images to be driven to may be referred to as a first next image and a second next image, respectively.

If there are a series of interrupting commands, the series of images to be driven to may be referred to as the first next image, the second next image, the third next image, and so on.

In the driving method of the present invention, a particular driving phase may be applied more than once. In such a case, when a driving phase is applied the first time, it is referred to as "a first phase X" and when the same driving phase is applied in subsequent steps, it is referred to as "a second phase X", "a third phase X" and so on. It is noted that the same driving phase, when applied multiple times, is independent of each other, which means that, for example, the first phase X is independent of the phase X applied in subsequent steps. For example, the first phase X may be a full phase X and a subsequent phase X may be a partial phase X.

Figure 4:
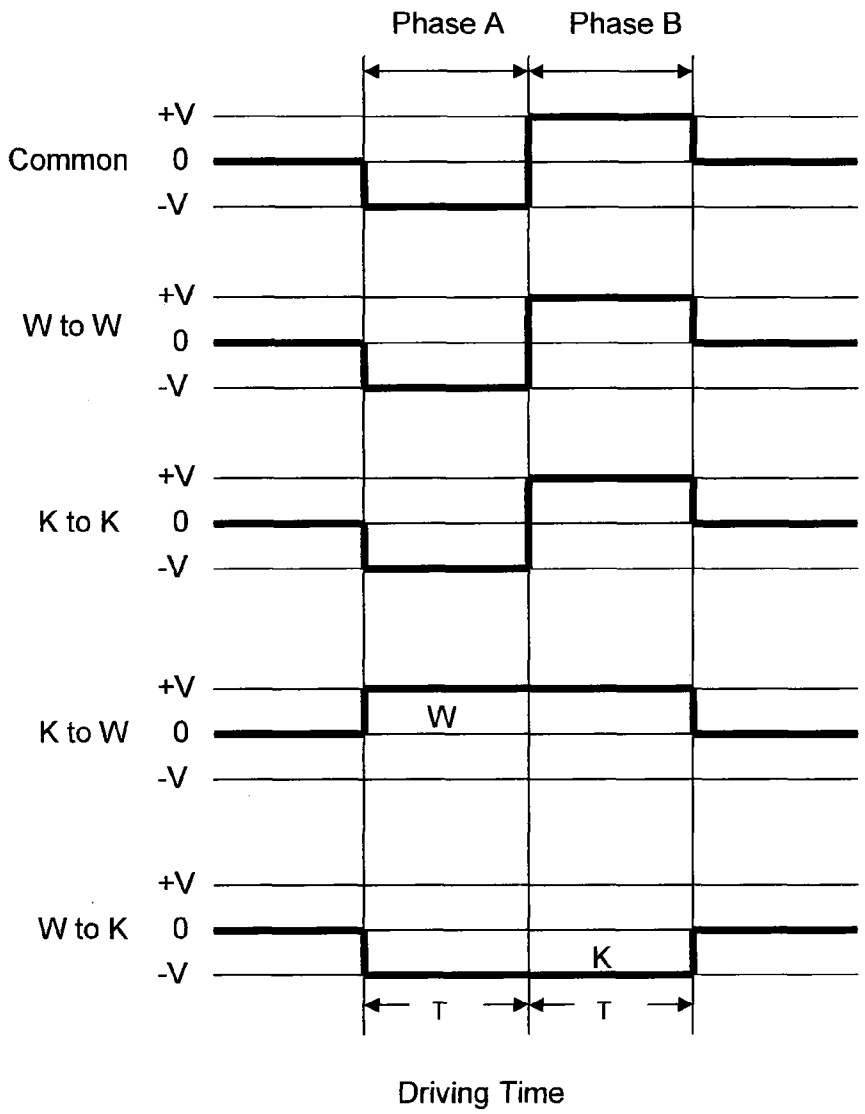
FIG. 4 illustrates a set of driving waveforms applicable to the present invention.

The terms "phase A" and "phase B" are exemplified in FIG. 4 and the waveforms of FIG. 4 are used in the examples for convenience. However, the two terms are intended to cover any two phases, one of which drives pixels from a first color to a second color and the other phase drives pixels from the second color to the first color, in any waveforms.

The terms "phase A" and "phase B" may also be referred to as "waveform phase A" and "waveform phase B", respectively.

Figure 1:
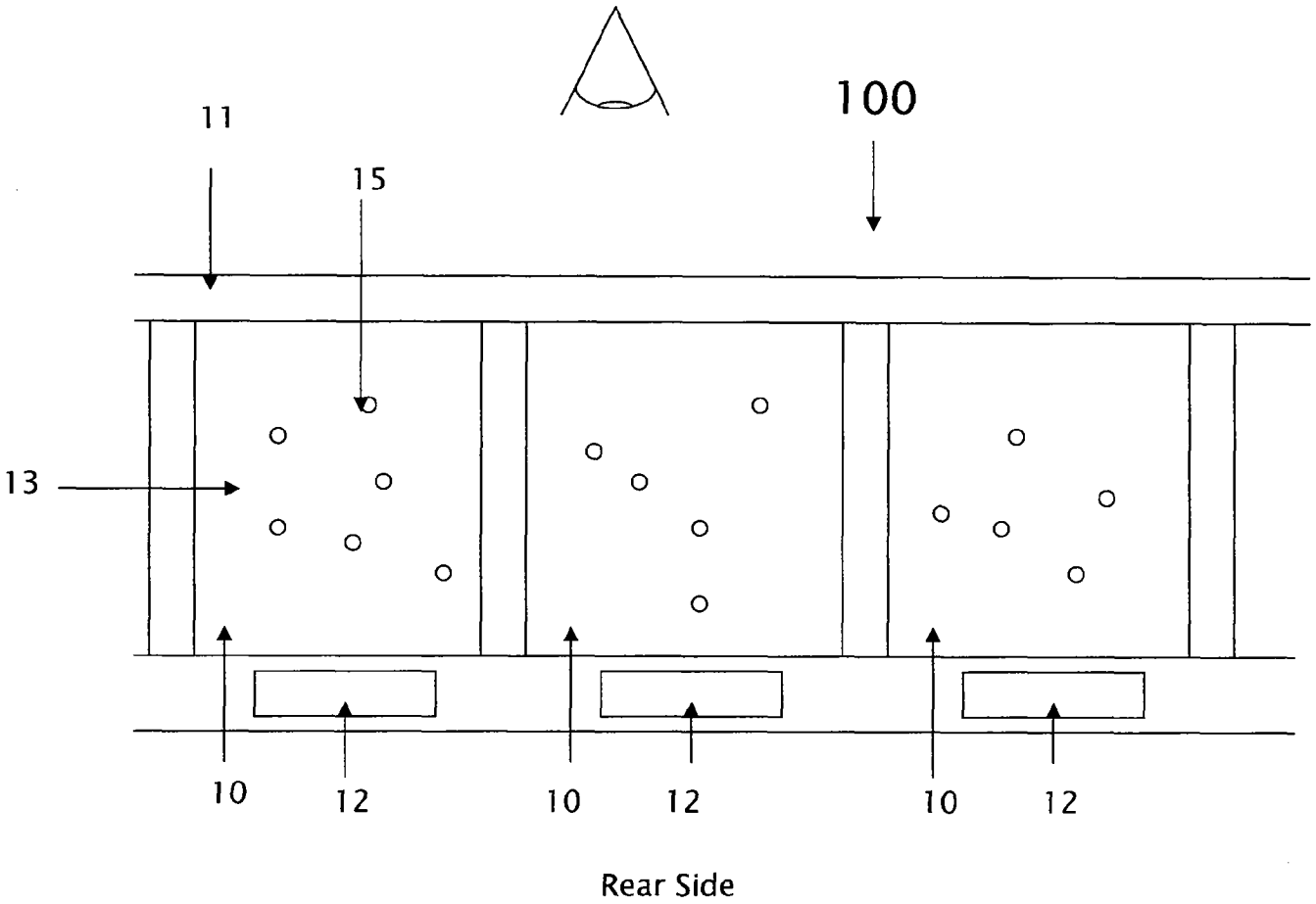
FIG. 1 is a cross-section view of a typical electrophoretic display device.

FIG. 1 illustrates a typical electrophoretic display 100 comprising a plurality of electrophoretic display cells 10. In FIG. 1, the electrophoretic display cells 10, on the front viewing side indicated with the graphic eye, are provided with a common electrode 11 (which is usually transparent and therefore on the viewing side). On the opposing side (i.e., the rear side) of the electrophoretic display cells 10, a substrate includes discrete pixel electrodes 12. Each of the pixel electrodes defines an individual pixel of the electrophoretic display. In practice, a single display cell may be associated with one discrete pixel electrode or a plurality of display cells may be associated with one discrete pixel electrode.

An electrophoretic fluid 13 comprising charged pigment particles 15 dispersed in a solvent is filled in each of the display cells. The movement of the charged particles in a display cell is determined by the driving voltage associated with the display cell in which the charged particles are filled.

If there is only one type of pigment particles in the electrophoretic fluid, the pigment particles may be positively charged or negatively charged. In another embodiment, the electrophoretic display fluid may have a transparent or lightly colored solvent or solvent mixture and charged particles of two different colors carrying opposite charges, and/or having differing electro-kinetic properties.

The display cells may be of a conventional walled or partition type, a microencapsulated type or a microcup type. In the microcup type, the electrophoretic display cells may be sealed with a top sealing layer. There may also be an adhesive layer between the electrophoretic display cells and the common electrode.

The term "display cell" is intended to refer to a microcontainer which is individually filled with a display fluid. Examples of "display cell" include, but are not limited to, microcups, microcapsules, micro-channels, other partition-type display cells and equivalents thereof.

The term "driving voltage" is used to refer to the voltage potential difference experienced by the charged particles in the area of a pixel. The driving voltage is the potential difference between the voltage applied to the common electrode and the voltage applied to the pixel electrode. As an example, in a binary system, positively charged white particles are dispersed in a black solvent. When no voltage is applied to a common electrode and a voltage of +15V is applied to a pixel electrode, the "driving voltage" for the charged pigment particles in the area of the pixel would be +15V. In this case, the driving voltage would move the positively charged white particles to be near or at the common electrode and as a result, the white color is seen through the common electrode (i.e., the viewing side). Alternatively, when no voltage is applied to a common electrode and a voltage of −15V is applied to a pixel electrode, the driving voltage, in this case, would be −15V and under such −15V driving voltage, the positively charged white particles would move to be at or near, the pixel electrode, causing the color of the solvent (black) to be seen at the viewing side.

Figure 2:
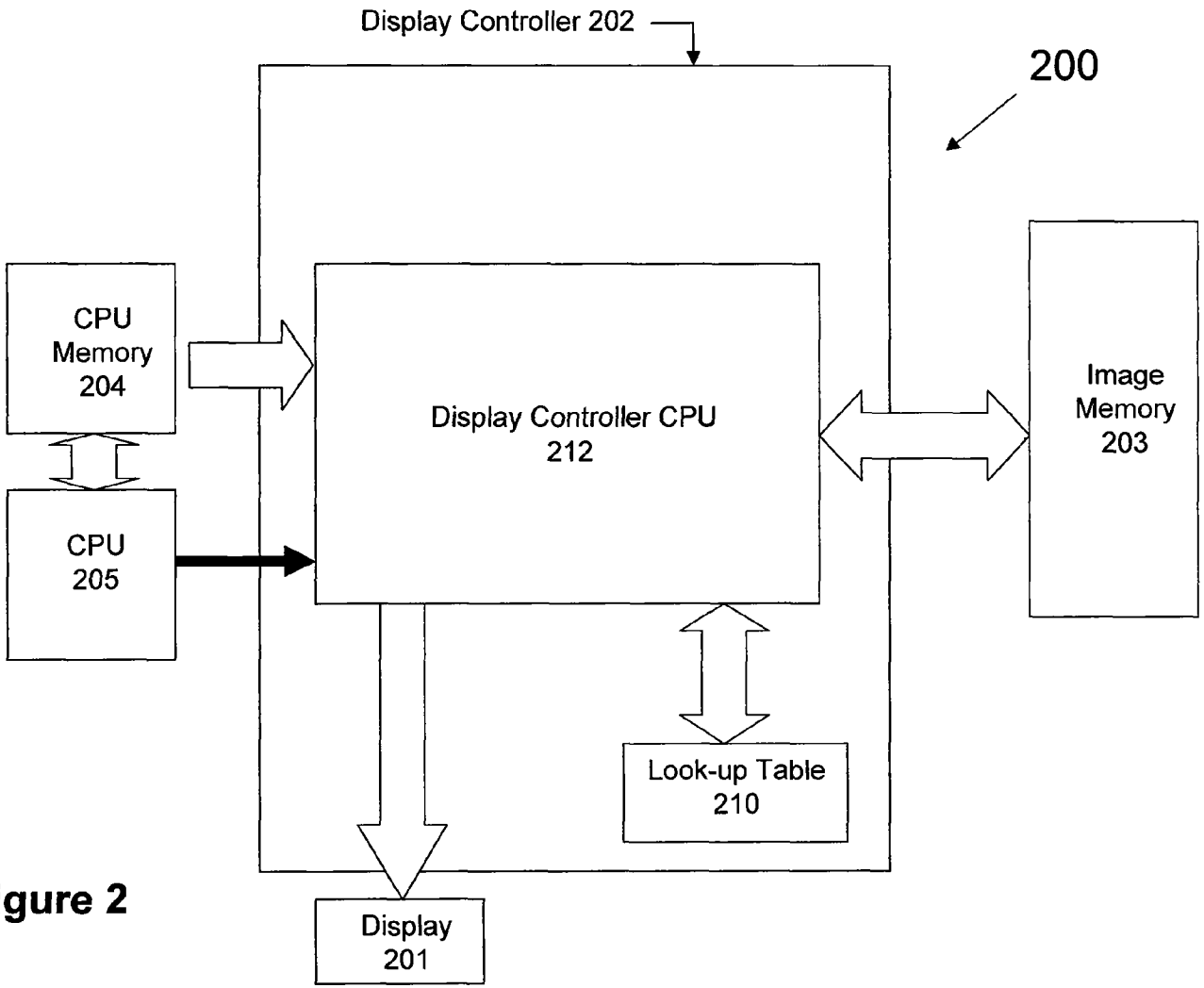
FIG. 2 illustrates a display controller system.

An example of a display controller system 200 is shown in FIG. 2. The CPU 205 is able to read to or write to CPU memory 204. In a display application, the images are stored in the CPU memory 204. When an image is to be displayed, the CPU 205 sends a request to the display controller 202. CPU 205 then instructs the CPU memory 204 to transfer the image data to the display controller 202.

When an image update is being carried out, the display controller CPU 212 accesses the current image and the next image from the image memory 203 and compares the two images. Based on the comparison, the display controller CPU 212 consults a lookup table 210 to find the appropriate waveform for each pixel. More specifically, when driving from a current image to a next image, a proper driving waveform is selected from the look-up table for each pixel, depending on the color states in the two consecutive images of that pixel. For example, a pixel may be in the white state in the current image and in the level 5 grey state in the next image, a waveform is chosen accordingly.

The selected driving waveforms are sent to the display 201 to be applied to the pixels to drive the current image to the next image. The driving waveforms however are sent, frame by frame, to the display. The term "frame" represents timing resolution of a waveform and is illustrated in a section below.

In practice, the common electrode and the pixel electrodes are separately connected to two individual circuits and the two circuits in turn are connected to a display controller. The display controller sends waveforms to the circuits to apply appropriate voltages to the common and pixel electrodes respectively. More specifically, the display controller, based on the current and next images, selects appropriate waveforms and then sends the waveforms, frame by frame, to the circuits to execute the waveforms by applying appropriate voltages to the common and pixel electrodes. The pixel electrodes may be a TFT (thin film transistor) backplane.

Figure 3:
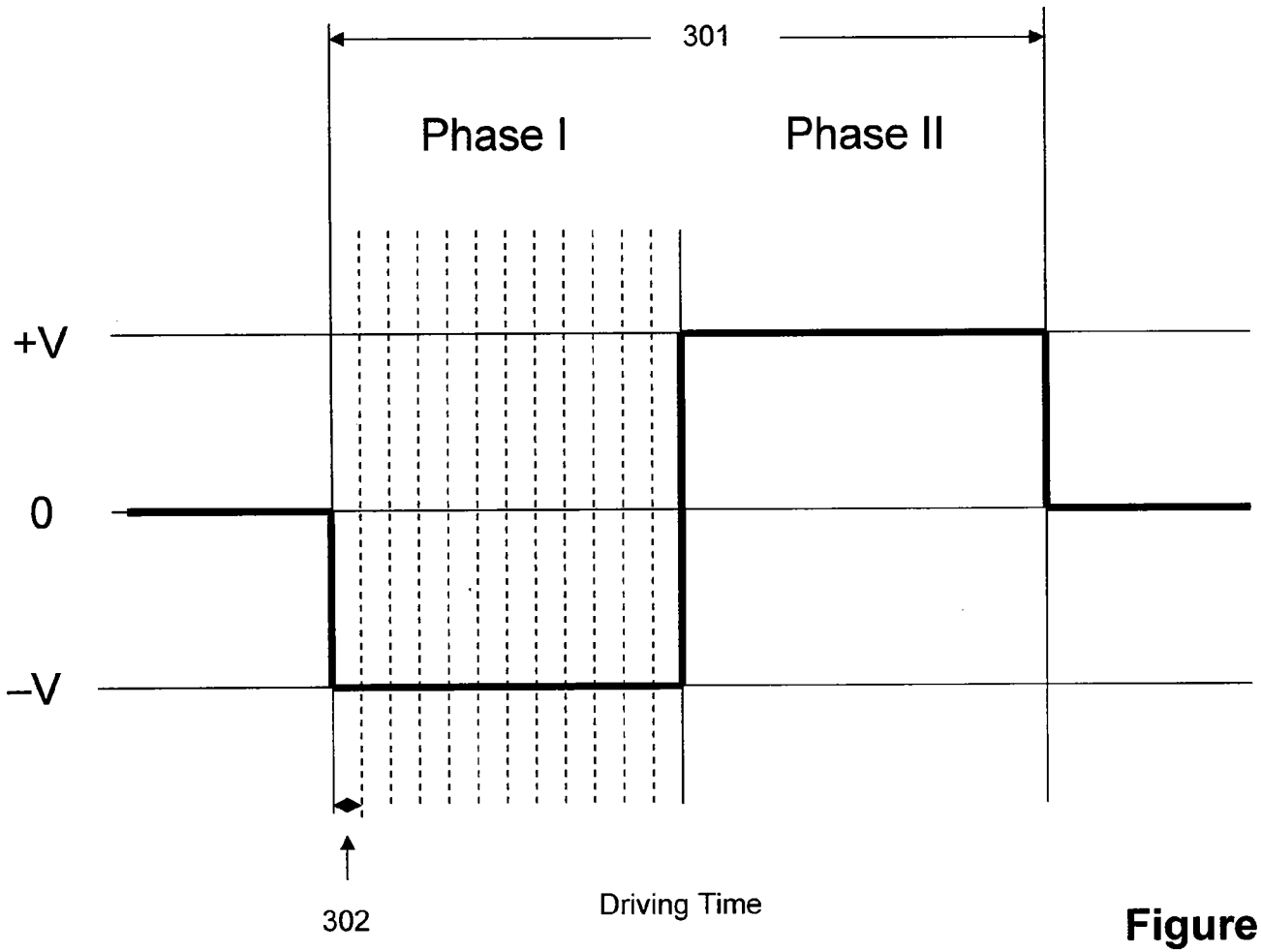
FIG. 3 illustrates an example driving waveform.

FIG. 3 shows an example of a driving waveform. In this figure, the vertical axis denotes the intensity of the applied voltages whereas the horizontal axis denotes the driving time. The length of 301 is the driving waveform period. There are two driving phases, I and II, in this example driving waveform.

There are frames 302 within the driving waveform, as shown. When driving an EPD on an active matrix backplane, it usually takes many frames for the image to be displayed. During each frame, a voltage is applied to a pixel. For example, during frame period 302, a voltage of −V is applied to the pixel.

The length of a frame is an inherent feature of an active matrix TFT driving system and it is usually set at 20 msec (milli-second). But typically, the length of a frame may range from 2 msec to 100 msec.

There may be as many as 1000 frames in a waveform period, but usually there are 20-40 frames in a waveform period.

In the example waveform, there are 12 frame periods in phase I. Assuming phase I and phase II have the same driving time, and then this waveform would have 24 frames. Given the frame length being 20 msec, the waveform period 301 would be 480 msec.

It is noted the numbers of frames in the two phases do not have to be the same.

FIG. 4 shows a set of driving waveforms which may be applicable for the present invention. It is assumed in this example that the charged pigment particles are white and positively charged and they are dispersed in a black solvent.

For the common electrode, a voltage of −V is applied in phase A and a voltage of +V is applied in phase B. For a white pixel to remain in the white state and a black pixel to remain in the black state, the voltages applied to the pixel both in phase A and phase B are the same as those applied to the common electrode, thus zero "driving voltage".

For a black pixel to be driven to the white state, a voltage of +V is applied in both phase A and phase B, causing the black pixel to change to the white color in phase A.

For a white pixel to be driven to the black state, a voltage of −V is applied in both phase A and phase B, causing the white pixel to change to the black color in phase B. Therefore, when this set of waveforms is applied to update images, the black pixels always change to the white color (in phase A) before the white pixels change to the black color (in phase B).

The waveforms can easily be modified to allow that the white pixels change to the black color (in phase A) before the black pixels change to the white color (in phase B).

In the waveforms as shown, the driving time for each phase is assumed to be 240 msec.

The first aspect of the present invention is directed to a driving method for continuously updating multiple images utilizing phase A which drives pixels of a first color to a second color and phase B which drives pixels of the second color to the first color, which method comprises the following steps:

a) completing a phase A to update a current image to an intermediate state image, in response to an initial command to update the current image to a first next image; and b) completing a phase B to update the intermediate state image to a second next image, in response to a second command which is received in the phase A to update to the second next image.

The term "intermediate state image" is illustrated below.

In the method as described, there are two consecutive commands and the interrupting second command is received during the phase A.

For step (a), a display controller, in response to a first command to update a current image to a first next image, compares the current image and the first next image, finds proper waveforms and sends the waveforms to the display to update the current image to the first next image.

For step (b), the display controller, in response to a second command to update to a second next image, compares the intermediate state image and the second next image, finds proper waveforms and sends the waveforms to the display to update to the second next image.

In one embodiment of this aspect of the present invention, there may be one or more interrupting commands in the phase A in step (a). In this case, step (a), in response to the initial command, needs to be completed before the subsequent command(s) are executed.

In another embodiment, there may be one or more interrupting commands in the phase B in step (b). The processing of interrupting subsequent command(s) in the phase B is discussed below.

The second aspect of the present invention is directed to a driving method for continuously updating multiple images utilizing phase A which drives pixels of a first color to a second color and phase B which drives pixels of the second color to the first color, which method comprises the following steps:

a) completing a first phase A to update a current image to an intermediate state image, in response to an initial command to update the current image to a first next image;

b) partially completing a first phase B to update to a transition image and terminating the first phase B, in response to a second command to update to a second next image which command is received in the first phase B;

c) starting a second phase A at an appropriate frame and completing the second phase A to update to a second intermediate state image; and d) completing a second phase B to update to the second next image.

The term "intermediate state image" is illustrated below.

In the method as described, there are two consecutive commands and the interrupting second command is received during the first phase B.

For steps (a) and (b), a display controller, in response to a first command to update a current image to a first next image, compares the current image and the first next image, finds proper waveforms and sends the waveforms to the display to update the current image to the first next image.

For step (c), a counter is needed to determine how many frames have been completed in the first phase B in step (b) and the driving is started in a second phase A at an appropriate frame, after both processing of a second command and the driving frame at that time are completed. For example, if the second command is received during frame 1 of the first phase B and the processing of the second command is completed in the middle of frame 3 in the first phase B, then the driving in the first phase B is terminated and a second phase A is started, only after frame 3 of the first phase B is completed.

The image visually appears at the point when the first phase B is terminated is referred to as a "transition image" (TI).

When the first phase B is terminated and a second phase A is started, the display controller, at this point, takes the first next image as the current image and an intermediate state image ISI as the next image to update the transition image to the intermediate state image ISI.

The counter determines the number of frames which have been completed in the first phase B already driven and the counter also notifies the display controller to have a second phase A started at an appropriate frame which frames allows the number of frames in the second phase A to be driven to be the same as the number of frames which have been completed in the first phase B. For example, if a phase A has "N" frames and there are "n" frames in the first phase B which have been completed, the driving in the second phase A then would restart at frame number (N−n+1). Examples are given below for this aspect of the invention.

For step (d), after the second phase A is completed, the display controller compares the intermediate state image and a second next image, selects appropriate waveforms and sends the waveforms to the display to update to the second next image.

In one embodiment of this second aspect of the present invention, there is only one interrupting command which is received in the first phase B, as described above.

In another embodiment, there may be more than one interrupting command in the phase B.

For brevity, the term "intermediate state image" is used to refer to an image between the two consecutive images.

As stated, in FIG. 4 above, the black pixels always change to the white color (in phase A) before the white pixels change to the black color (in phase B). Therefore, as an example, at the end of phase A in FIG. 4, an intermediate state image would be:

TABLE 1

| Pixel in Current Image | Same Pixel in Next Image | Same Pixel in Intermediate State Image |
|---|---|---|
| White | White | White |
| Black | White | White |

TABLE 1-continued

| Pixel in Current Image | Same Pixel in Next Image | Same Pixel in Intermediate State Image |
|---|---|---|
| White | Black | White |
| Black | Black | Black |

Figure 8:
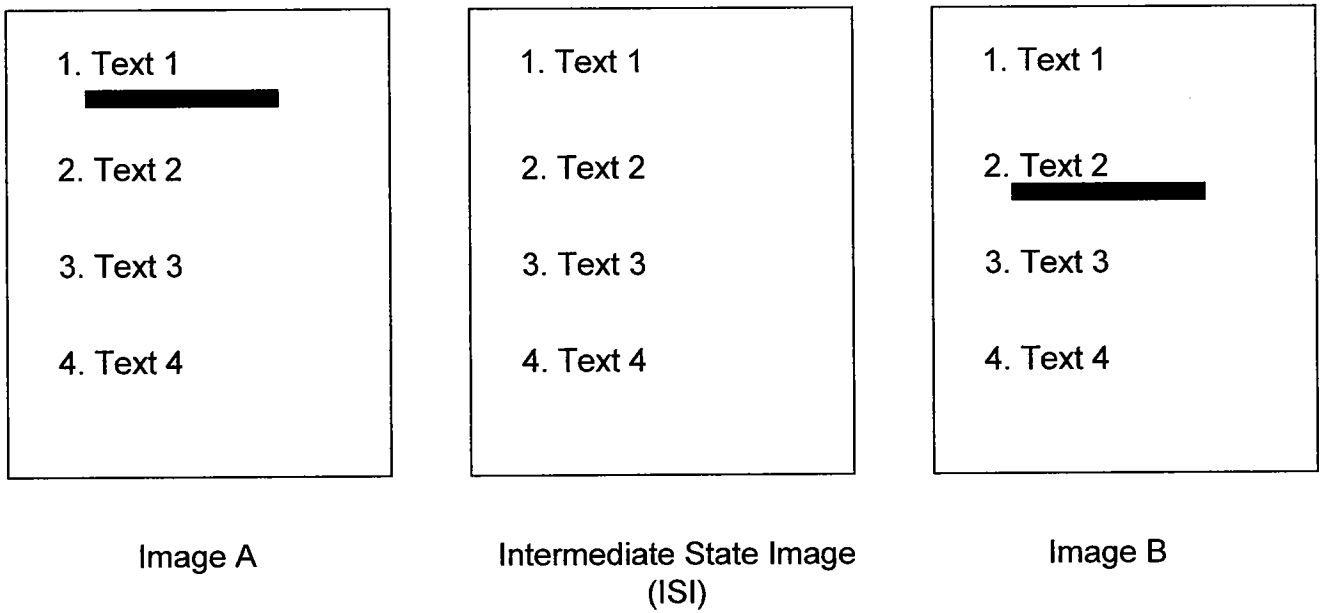
FIG. 8 shows an example of "intermediate state image".

This intermediate state image is also shown in FIG. 8.

This may be generalized in Table 2 for a binary color system comprising a first color state and a second color state, and the pixels of the second color are driven to the first color state before the pixels of the first color state are driven to the second color state.

TABLE 2

| Pixel in Current Image | Same Pixel in Next Image | Same Pixel in Intermediate State Image |
|---|---|---|
| First Color | First Color | First Color |
| Second Color | First Color | First Color |
| First Color | Second Color | First Color |
| Second Color | Second Color | Second Color |

The "intermediate state image" is an essential feature of the driving methods of the present invention. An algorithm can be incorporated in a display controller to create intermediate state images as described above and the intermediate state images are stored in an image memory from which the display controller may retrieve the intermediate state images for comparison purposes.

Alternatively, this second aspect of the invention may be carried out in the following manner:

a) completing a first phase A to update a current image to an intermediate state image, in response to an initial command to update the current image to a first next image;

b) partially completing a first phase B to update to a transition image and terminating the first phase B, in response to a second command to update to a second next image which command is received in the first phase B;

c) completing a second phase B to update the transition image to a second transition image; and d) starting a second phase A at an appropriate frame and completing the second phase A to update the second transition image to the second next image.

In other words, the last two steps (c) and (d) in the second aspect of the invention are reversed.

EXAMPLES

For illustration purpose, the driving methods of the present invention are carried out utilizing the waveforms of FIG. 4 to drive from Image A to Image B, Image C or Image D.

Figure 5:
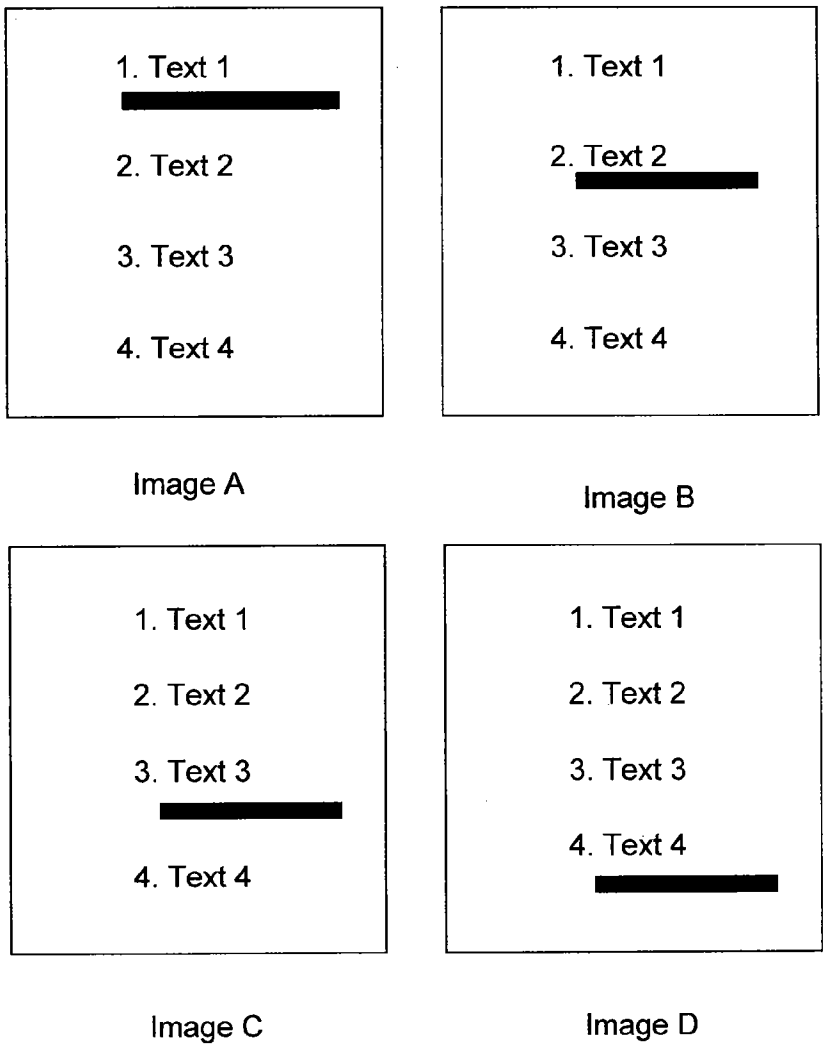
FIG. 5 illustrates four images A, B, C and D in which the cursor line is under different text lines.

Images A-D are shown in FIG. 5. The cursor (black line) is under "Text 1", "Text 2", "Text 3" and "Text 4" respectively in Images A, B, C and D.

Example 1

Prior Art Method

Figure 6:
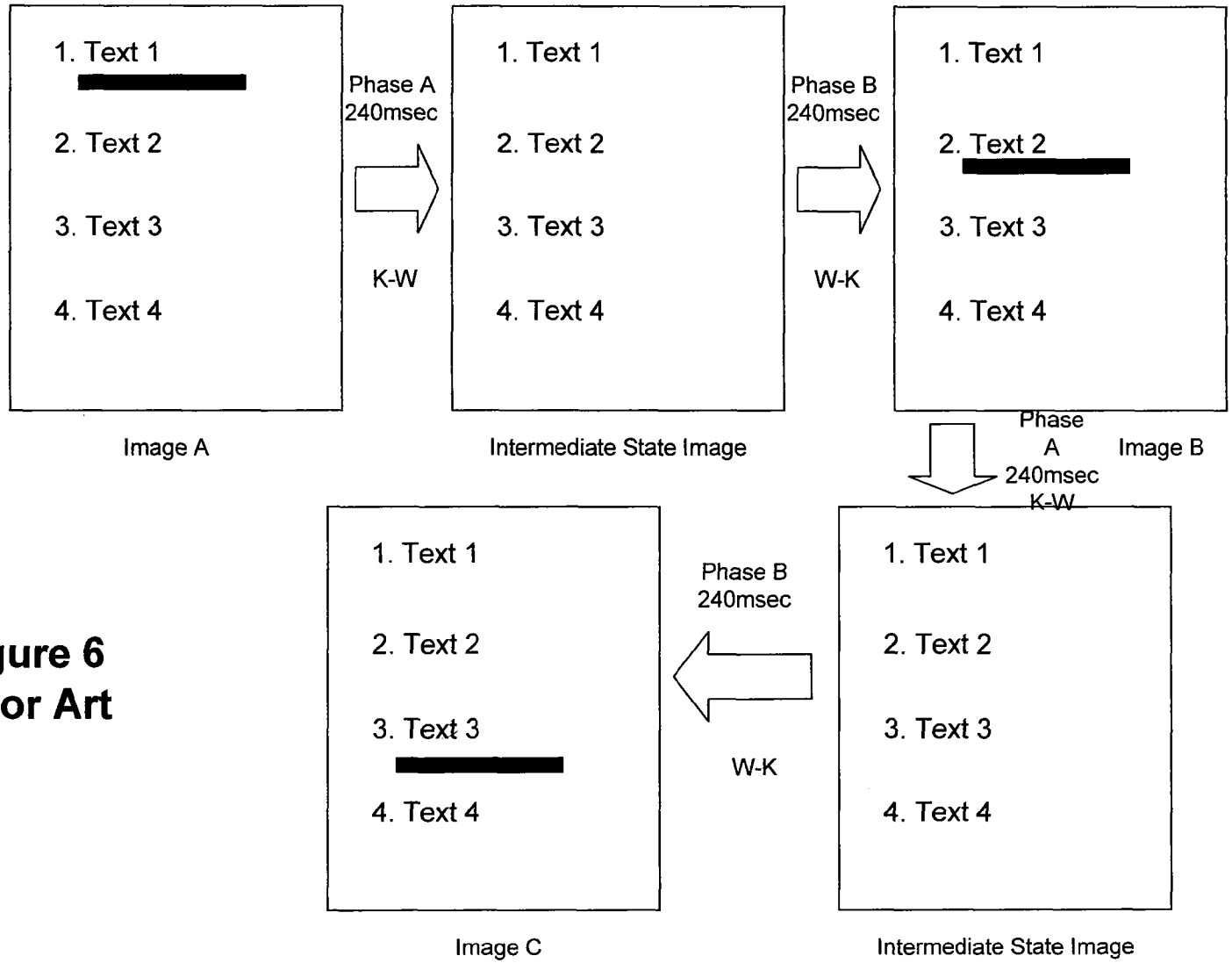
Figure 6 Prior Art
FIG. 6 illustrates a current (prior art) driving method.

FIG. 6 illustrates the current (prior art) driving method. An initial command is to drive image A to image B. Accordingly, the display controller compares image A and image B in the image memory and, based on the comparison, selects appropriate waveforms from a look up table and sends the selected waveforms to the display.

When the initial command is being processed and before the updating to image B is completed, a second command is received to update to image C. The second command cannot override the first command in the current method. In other words, the driving command already received is not interruptible. As a result, the driving from image A to image B must be completed before the driving to image C can start. Accordingly, in this process, after updating to image B is completed, the controller compares image B and image C, selects appropriate waveforms and sends the selected waveforms to the display.

Overall, the entire process involving the initial command and the second command consists of (i) driving the black pixels in image A to white (phase A) arriving at an intermediate state image, (ii) driving the white pixels in the intermediate state image to black (phase B) arriving at image B, (iii) driving the black pixels in image B to white (phase A) arriving at an intermediate state image, and (iv) finally driving the white pixels in the intermediate state image to black (phase B) arriving at image C.

As shown in FIG. 6, driving from image A to image C in this example takes four driving phases, which amount to a total driving time of 960 msec.

Example 2

Figure 7A:
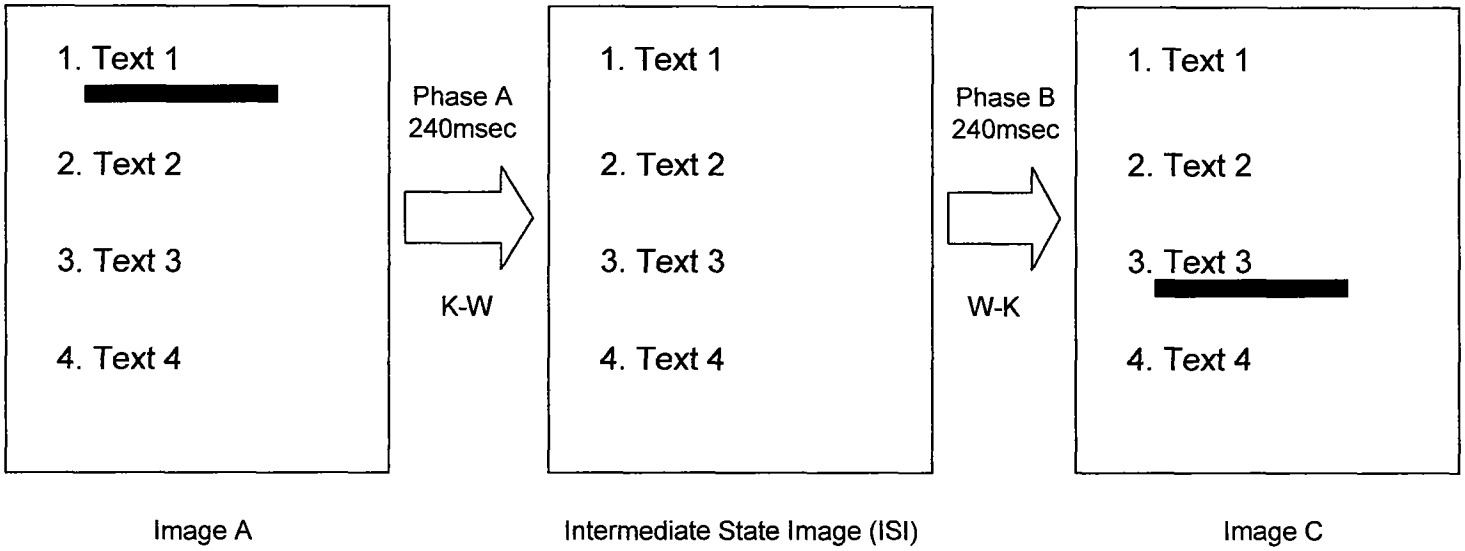
FIGS. 7*a* and 7*b* illustrate an example of the present invention.
Figure 7B:
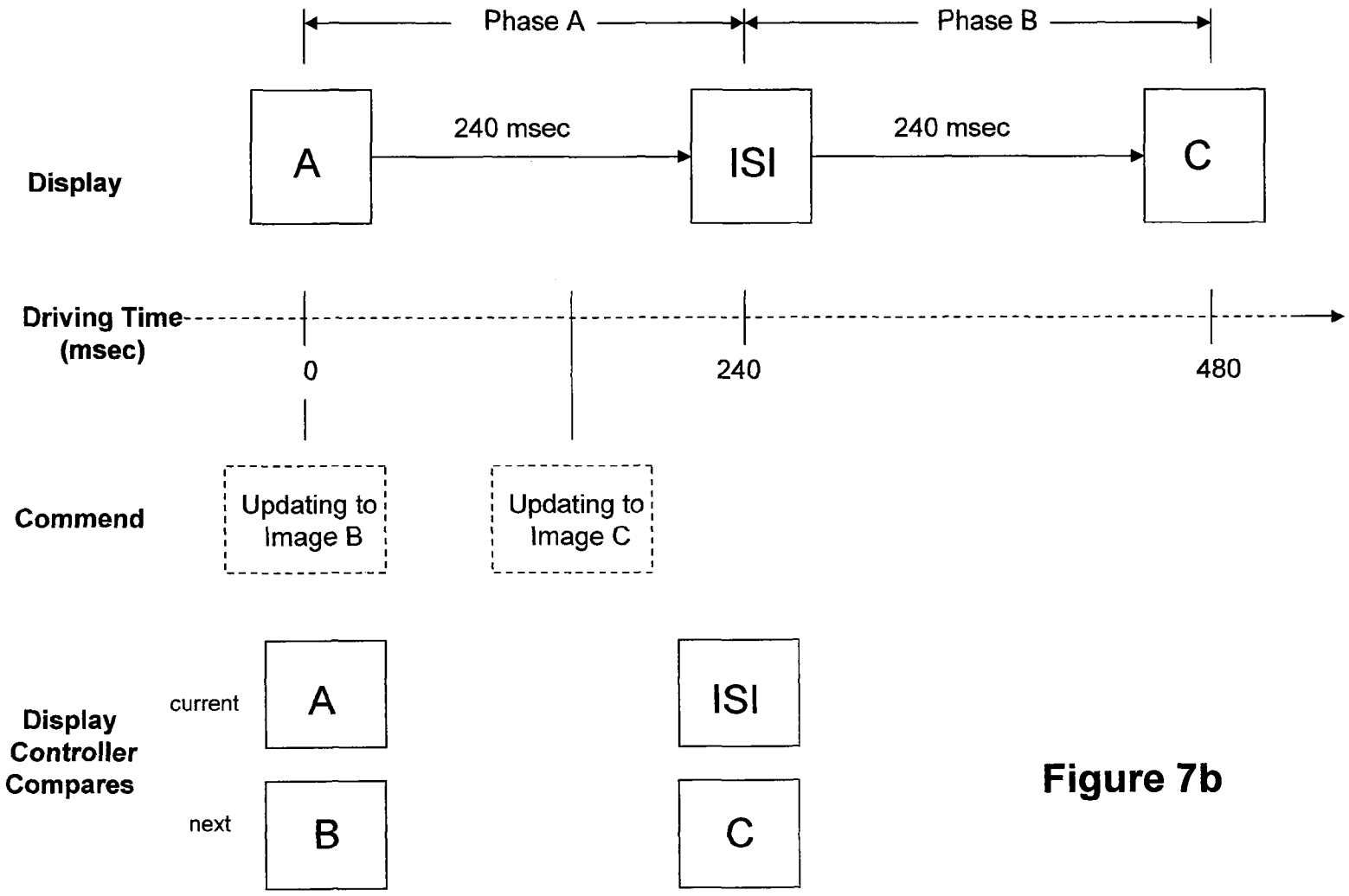

A driving method of the present invention is illustrated in FIGS. 7*a* and 7*b*, in which an interrupting second command is received in phase A of the driving waveforms.

FIG. 7*a* shows how the updating occurs, step by step. FIG. 7*b* includes a time line to indicate how the updating progresses and also how the display controller directs the updating process.

After an initial command to update to image B is received (at time 0 msec), the display controller compares image A and image B, finds appropriate waveforms in a look-up table and sends the selected waveforms to the display.

However, before driving in phase A is completed, a second command to update to image C instead of B is received. At this point, the driving should continue until phase A is completed to arrive at an intermediate state image, as shown in FIGS. 7*a* & 7*b*. This step takes 240 msec.

It is noted that since the waveforms of FIG. 4 allow the black pixels to be driven to white before the white pixels to be driven to black, the intermediate state image is the one as shown in Table 1 above and in FIG. 8.

Because of the second command to update to image C, the display controller then compares the intermediate state image and image C, finds waveforms and sends the selected waveforms to the display to update the intermediate state image to image C. The driving from the intermediate state image to image C involves phase B, i.e., driving white pixels to black. This step takes another 240 msec.

In the method as described, the driving time for the entire process is shortened to only two driving phases (i.e., 480 msec). In addition, the viewer will not see a transitional image B, which renders the screen appearance more pleasing to the viewers.

Example 3

Figure 9A:
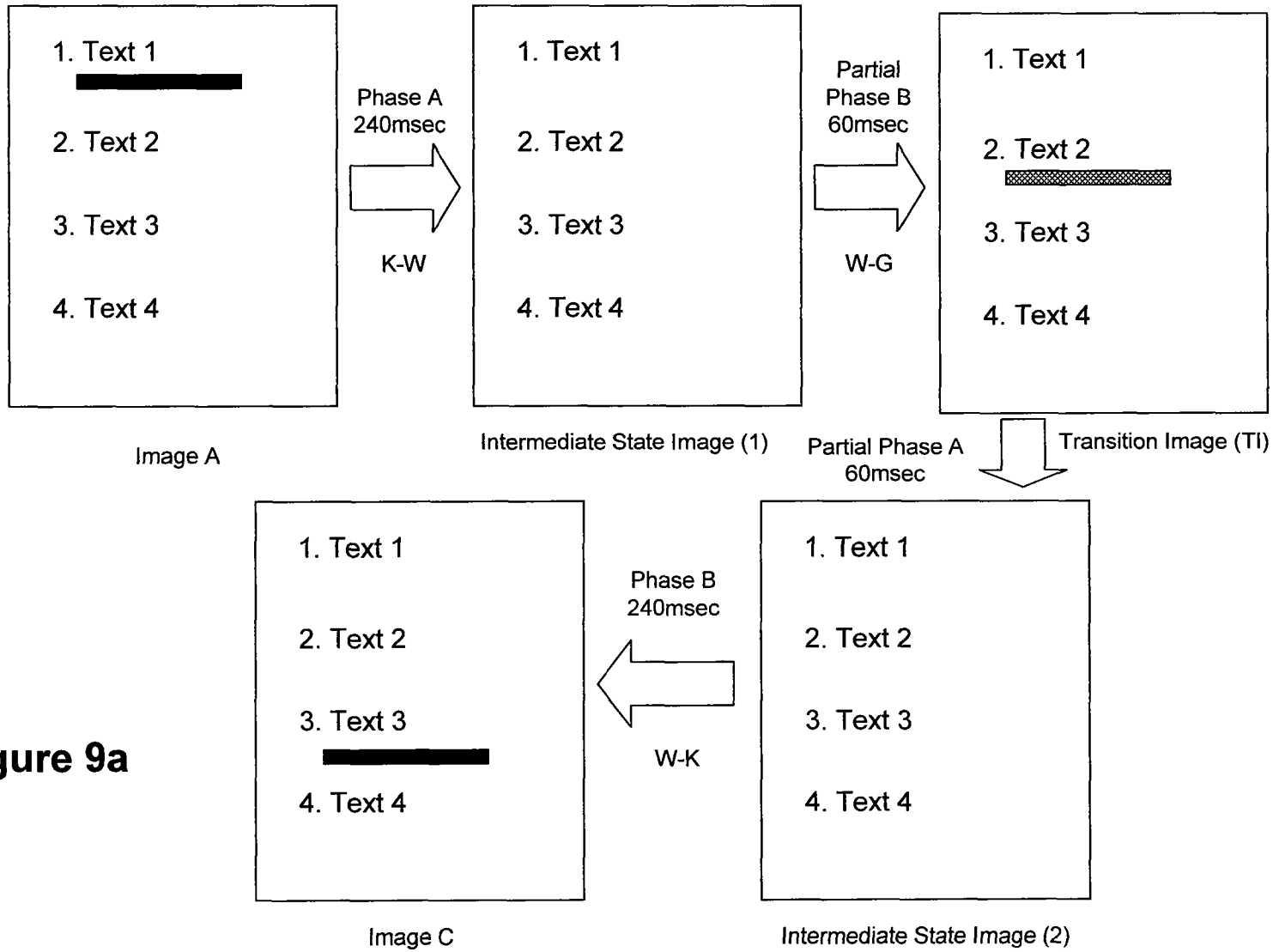
FIGS. 9*a*-9*c* illustrate another example of the present invention.
Figure 9B:
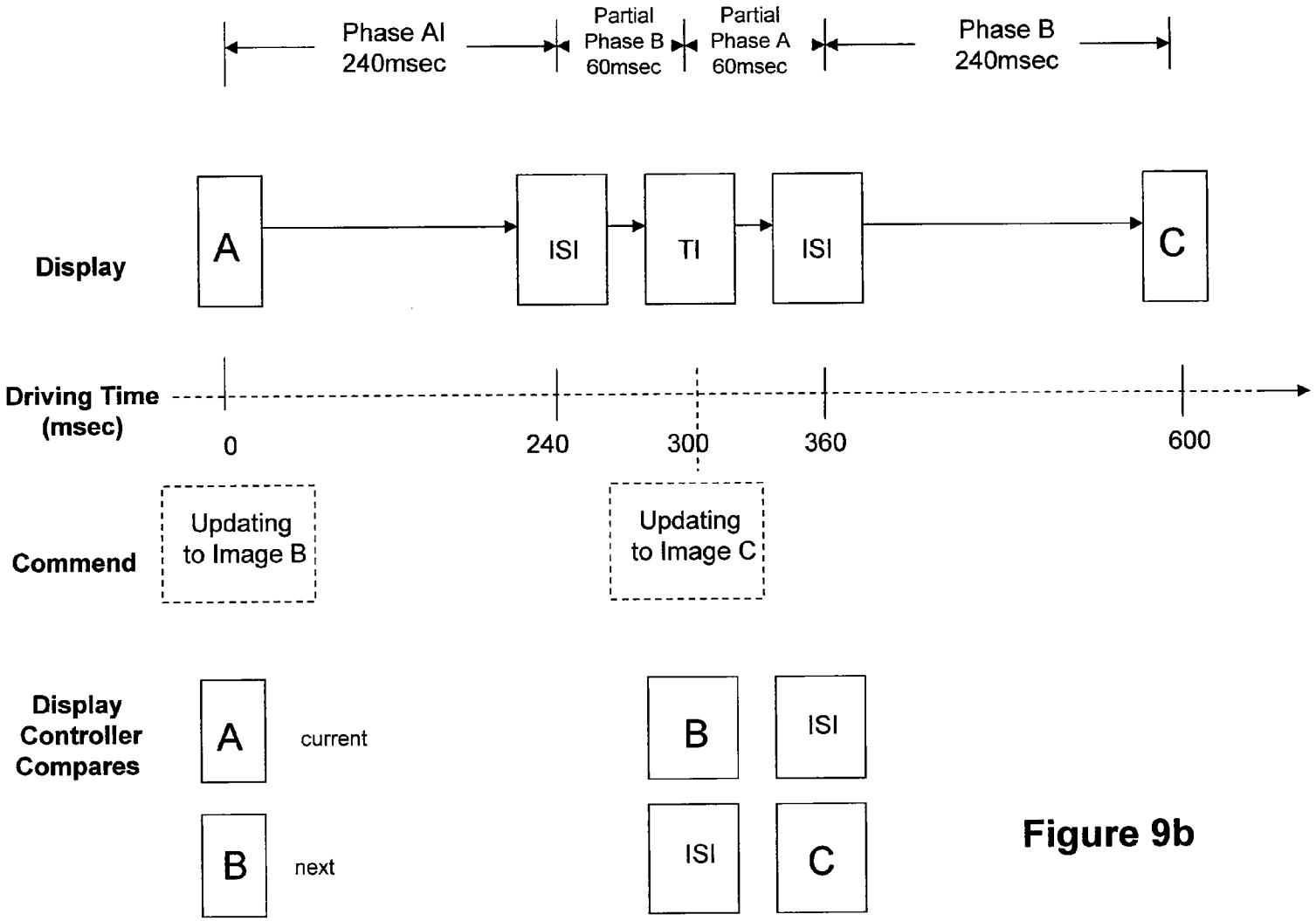
Figure 9C:
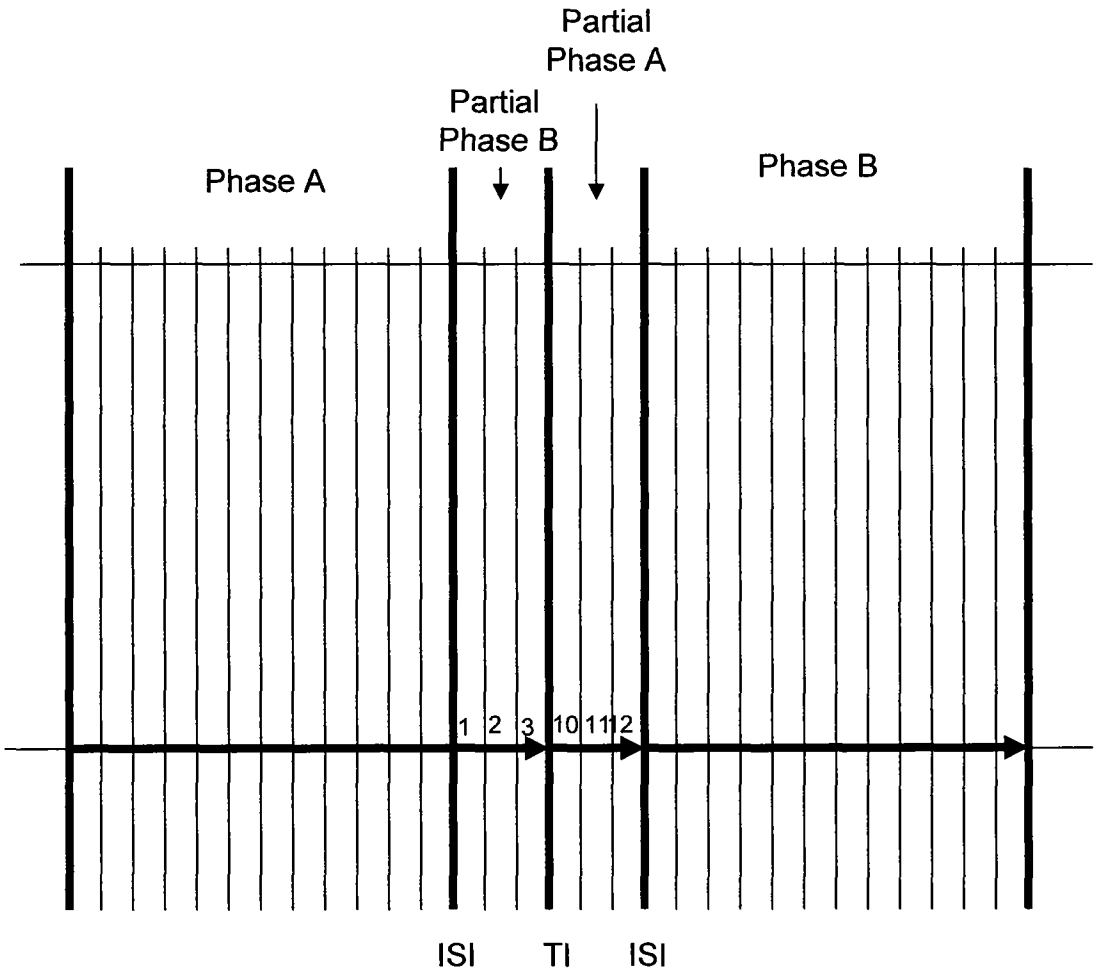

A driving method of the present invention in which an interrupting second command is received in phase B, is demonstrated in FIGS. 9*a*-9*c*.

In this example, at time 0 msec, the display controller, in response to an initial command to update image A to image B, compares image A and image B, finds appropriate waveforms and then sends the selected waveforms to the display.

However, unlike Example 2, a second command to update to image C is received during phase B, after phase A has been completed. In other words, image A has already been updated to an intermediate state image ISI and beyond.

At the time when the second command is received, the image appears as a transition image (TI) as shown in FIG. 9*a*. It is noted that since the transition image (TI) occurs in the middle of phase B, the cursor under Text 2 is in an intermediate color state, e.g., gray.

According to the present invention, the driving in this phase B is terminated and a second phase A is started at an appropriate frame, after both processing of the second command and the driving frame at that time are completed. For example, if the second command is received during frame 1 of phase B and the processing of the second command is completed in the middle of frame 3 in phase B, then the driving in phase B is terminated and the second phase A is started, only after frame 3 of the phase B is completed. In other words, three frames are "completed" in the phase B before the driving in the second phase A is started.

When the first phase B is terminated and the driving in the second phase A is started, the display controller, at this point, takes image B as the current image and an intermediate state image ISI as the next image (see FIG. 9*b*) to update the transition image (TI) to the intermediate state image ISI.

To accomplish this, a counter is needed to determine the number of frames which have been completed in the first phase B and the counter notifies the display controller to allow the second phase A to start at an appropriate frame. As shown in FIGS. 9*b* and 9*c*, phase A has 12 frames and there are 3 frames which have been completed in the previous phase B, the driving in the second phase A then would start at frame 10 (i.e., 12−3+1).

The driving then continues until the second phase A is completed (see also FIG. 9*c*), arriving at an intermediate state image ISI. The step from the first intermediate state image ISI to the second intermediate state image ISI takes 120 msec. The first intermediate state image and the second intermediate state image, in this case, are identical.

The display controller then compares the intermediate state image ISI and image C, finds appropriate waveforms and then sends the selected waveforms to the display to drive the intermediate state image to image C. This last step essentially is another phase B which drives white pixels to black and it would take 240 msec. The entire driving process, in this example, takes 600 msec.

It is noted that the earlier the interruption is in phase B, the more beneficial the present method is, in term of shortening the driving time.

Example 4

Figure 10:
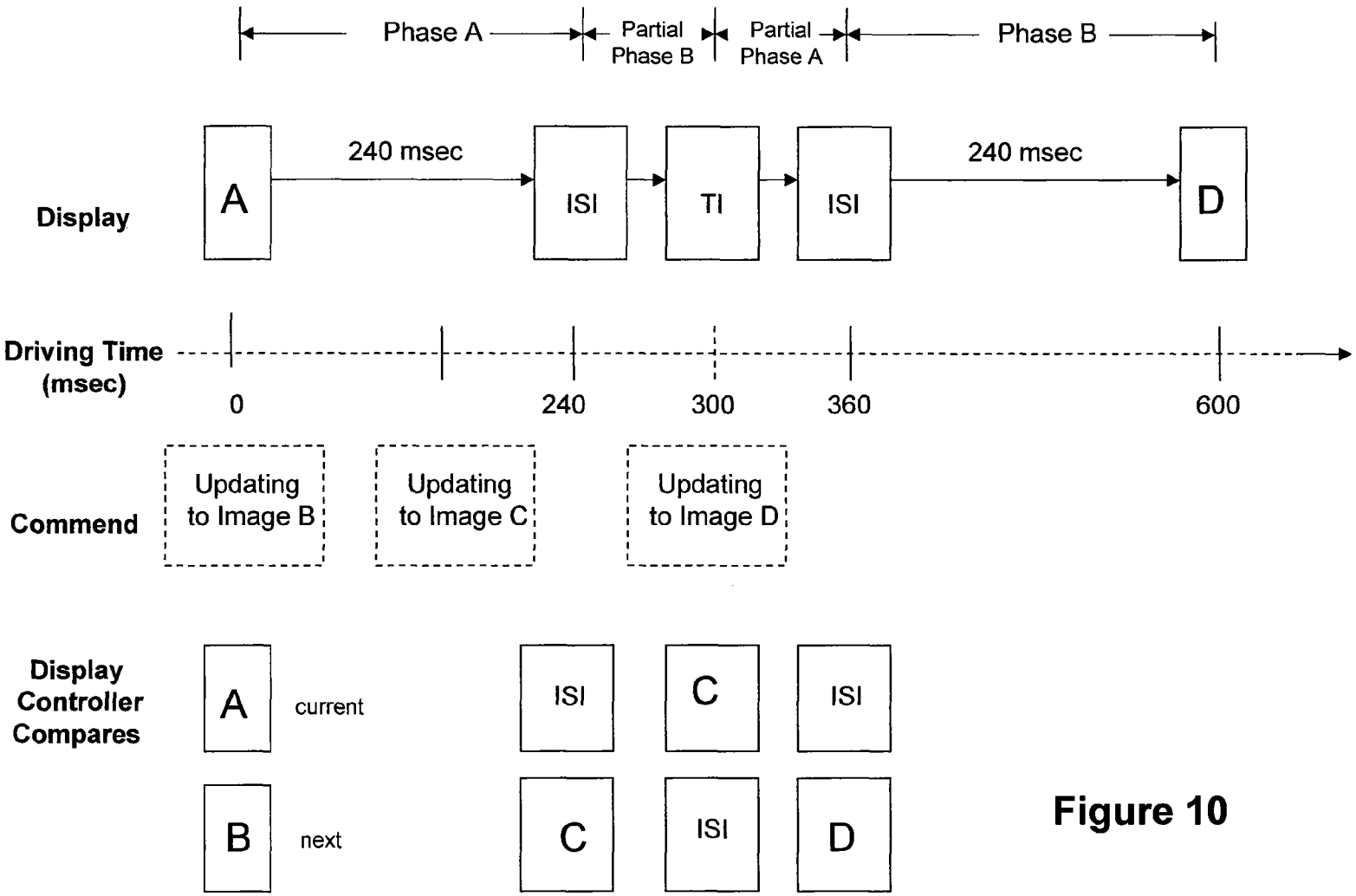
FIG. 10 illustrates a further example of the present invention.

A further example is shown in FIG. 10 in which there are two interrupting commands, one is received in phase A and the other in phase B.

After an initial command to update to image B is received (at time 0 msec), the display controller compares image A and image B, finds appropriate waveforms in a look-up table and sends the selected waveforms to the display.

However, before driving in the first phase A is completed, a second command to update to image C instead of B is received. At this point, the driving should continue until the first phase A is completed to arrive at an intermediate state image, as shown in FIG. 10. This step takes 240 msec.

At the end of the first phase A, the display controller compares the intermediate state image (as the current image) and image C (as the next image) to continue updating to image C, with phase B driving.

However after three frames have been completed in this first phase B, a third command is received to update to image D. At this point, a transition image (TI) is seen, and the display controller compares image C (as the current image) and an intermediate state image (as the next image) to update to the intermediate state image (ISI). In the meantime, similarly as demonstrated in Example 3, the driving in the first phase B is terminated and the driving in the second phase A is started at frame 10, assuming as in Example 3, that three frames are completed in the previous phase B.

When the second phase A is completed, arriving at a second intermediate state image, the display controller compares the second intermediate state image and image D and update the intermediate state image to image D. The two intermediate state images are identical.

The total driving time from image A to image D with two interruptions takes 600 msec.

Example 5

Figure 11A:
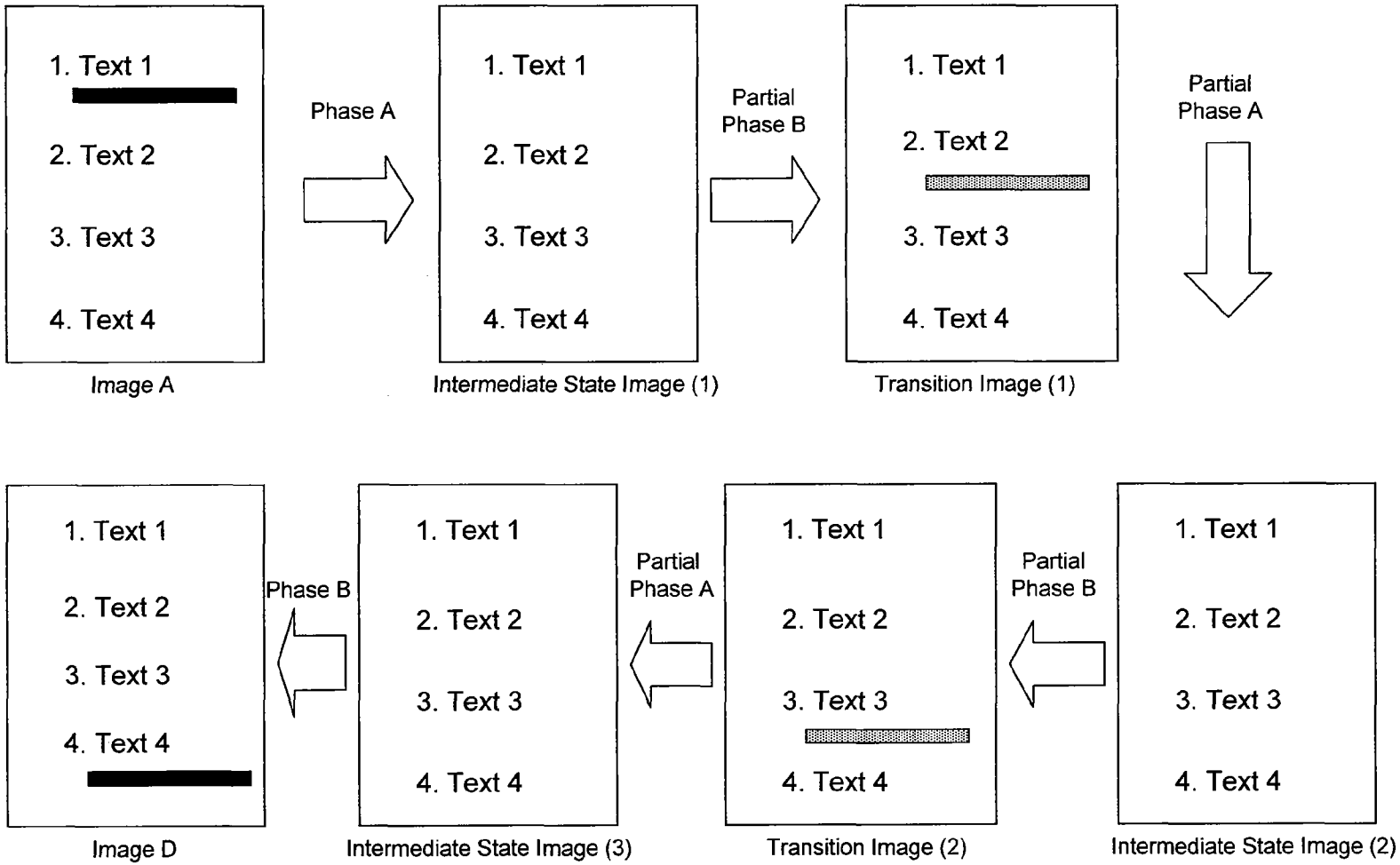
FIGS. 11*a*-11*c* illustrate yet a further example of the present invention.
Figure 11B:
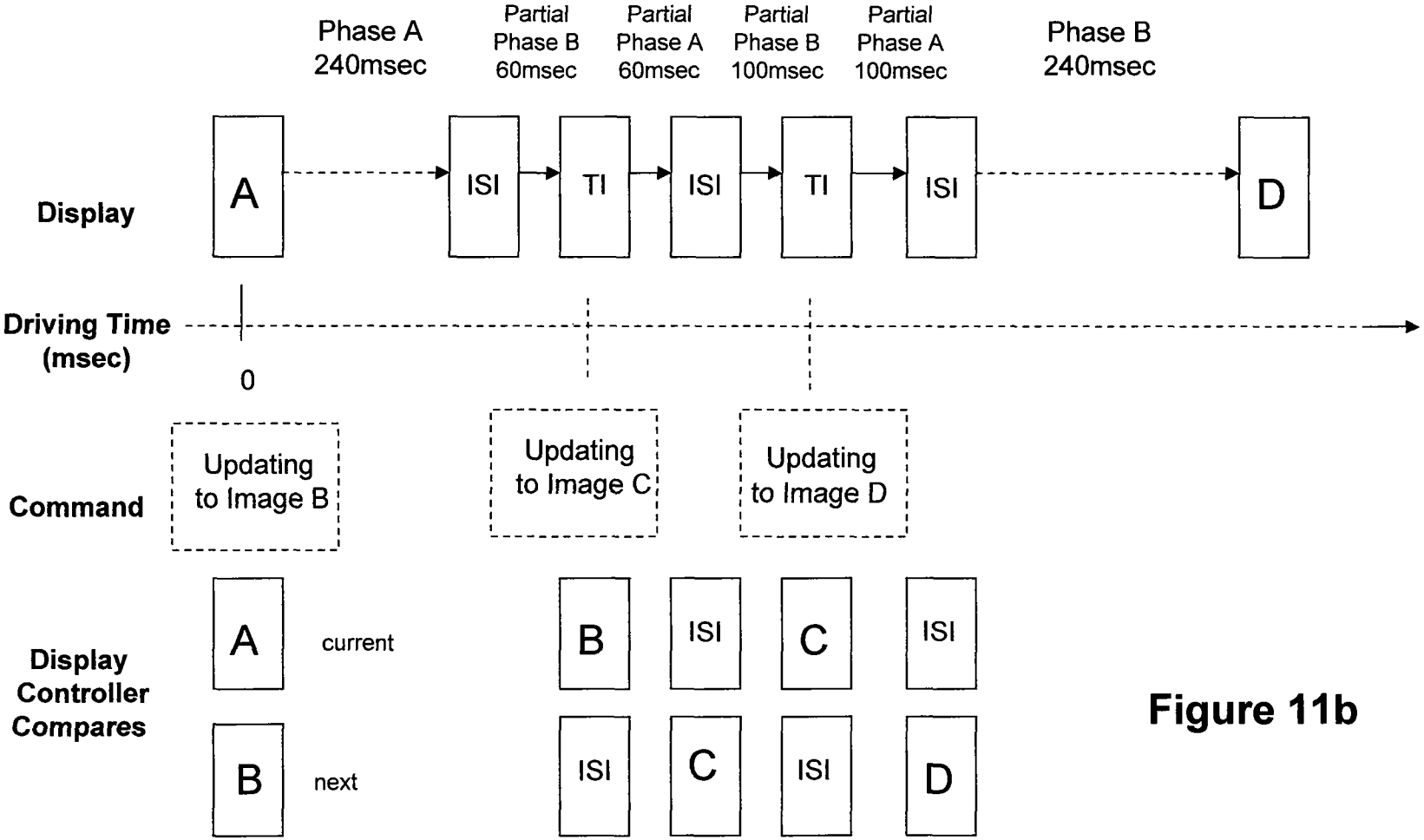
Figure 11C:
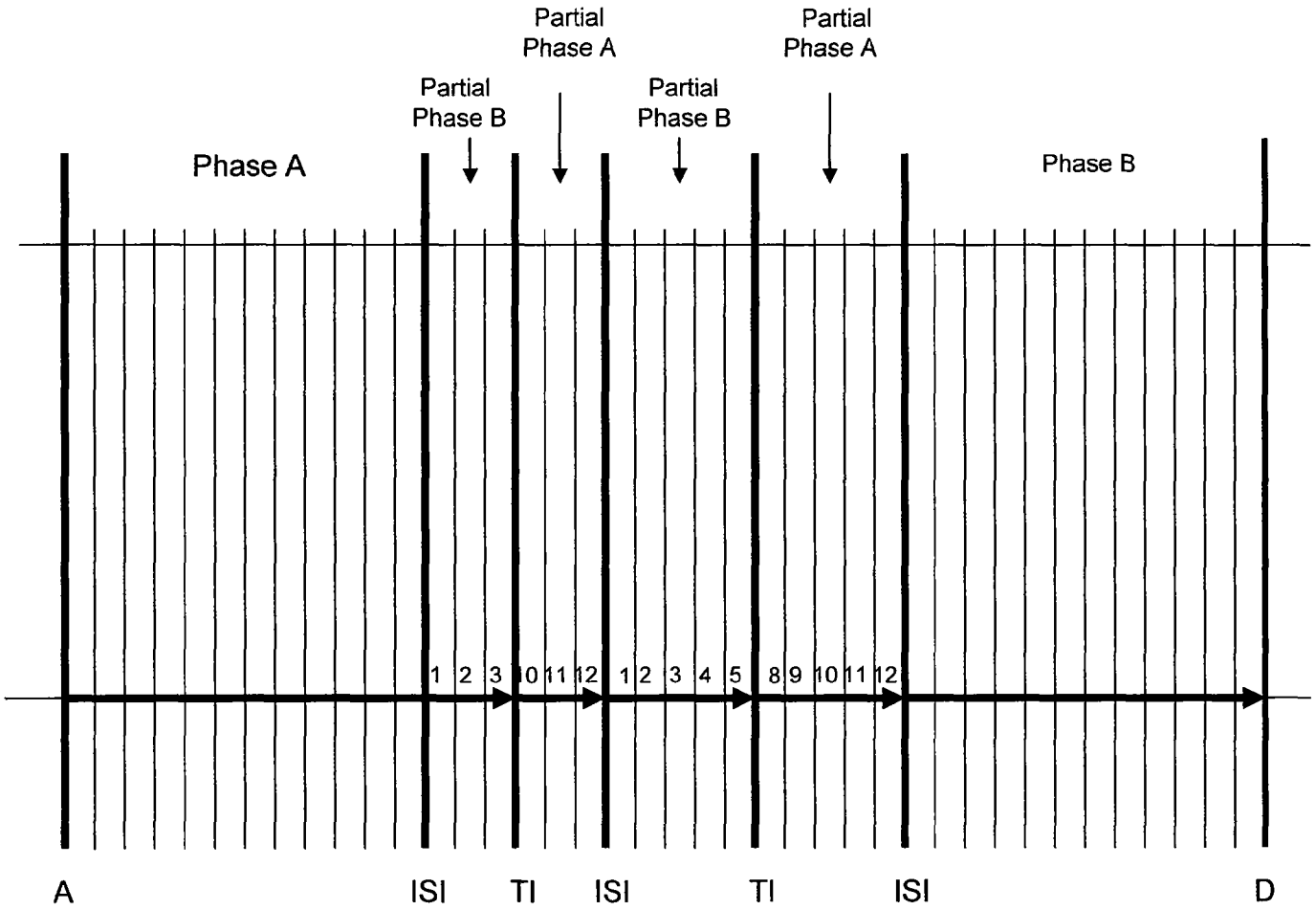

A further example is shown in FIGS. 11*a*-11*c* in which there are two interruptions, both in phase B.

After an initial command to update to image B is received (at time 0 msec), the display controller compares image A and image B, finds appropriate waveforms in a look-up table and sends the selected waveforms to the display.

However, a second command to update to image C is received during phase B, after phase A has been completed.

At the time when the second command is received, the image appears as a transition image (TI) as shown in FIG. 11*a*.

As shown in FIGS. 11*b* and 11*c*, the driving in phase B is terminated after frame 3 and a second phase A is started at frame 10, in response to the interrupting second command. The display controller, at this point, takes image B as the current image and an intermediate state image ISI as the next image (see FIG. 11*b*) to update the transition image to the intermediate state image ISI.

The driving then continues until the second phase A is completed (see also FIG. 11*c*), arriving at a second intermediate state image ISI. The step from the first intermediate state image ISI to the second intermediate state image ISI takes 120 msec.

The display controller then compares the intermediate state image ISI and image C, finds appropriate waveforms and then sends the selected waveforms to the display to drive the intermediate state image to image C in phase B.

A third command to update to image D is received in this second phase B. At the time when the third command is received, the image appears as another transition image (TI) as shown in FIG. 11*a*.

As shown in FIGS. 11*b* and 11*c*, the driving in the second phase B is terminated after frame 5 is completed and a second phase A is started at frame 8, in response to the interrupting third command. The display controller, at this point, takes image C as the current image and an intermediate state image ISI as the next image (see FIG. 11*b*) to update the transition image to the intermediate state image ISI.

The driving then continues until the second phase A is completed (see also FIG. 11*c*), arriving at a third intermediate state image ISI. The step from the second intermediate state image ISI to the third intermediate state image ISI takes 200 msec.

The display controller then compares the third intermediate state image ISI and image D, finds appropriate waveforms and then sends the selected waveforms to the display to drive the intermediate state image to image D in phase B.

All three intermediate state images, in this example, are identical.

This last step essentially is phase B driving white pixels to black, which takes 240 msec. The entire driving process, in this example, takes 800 msec.

Example 6

Figure 12A:
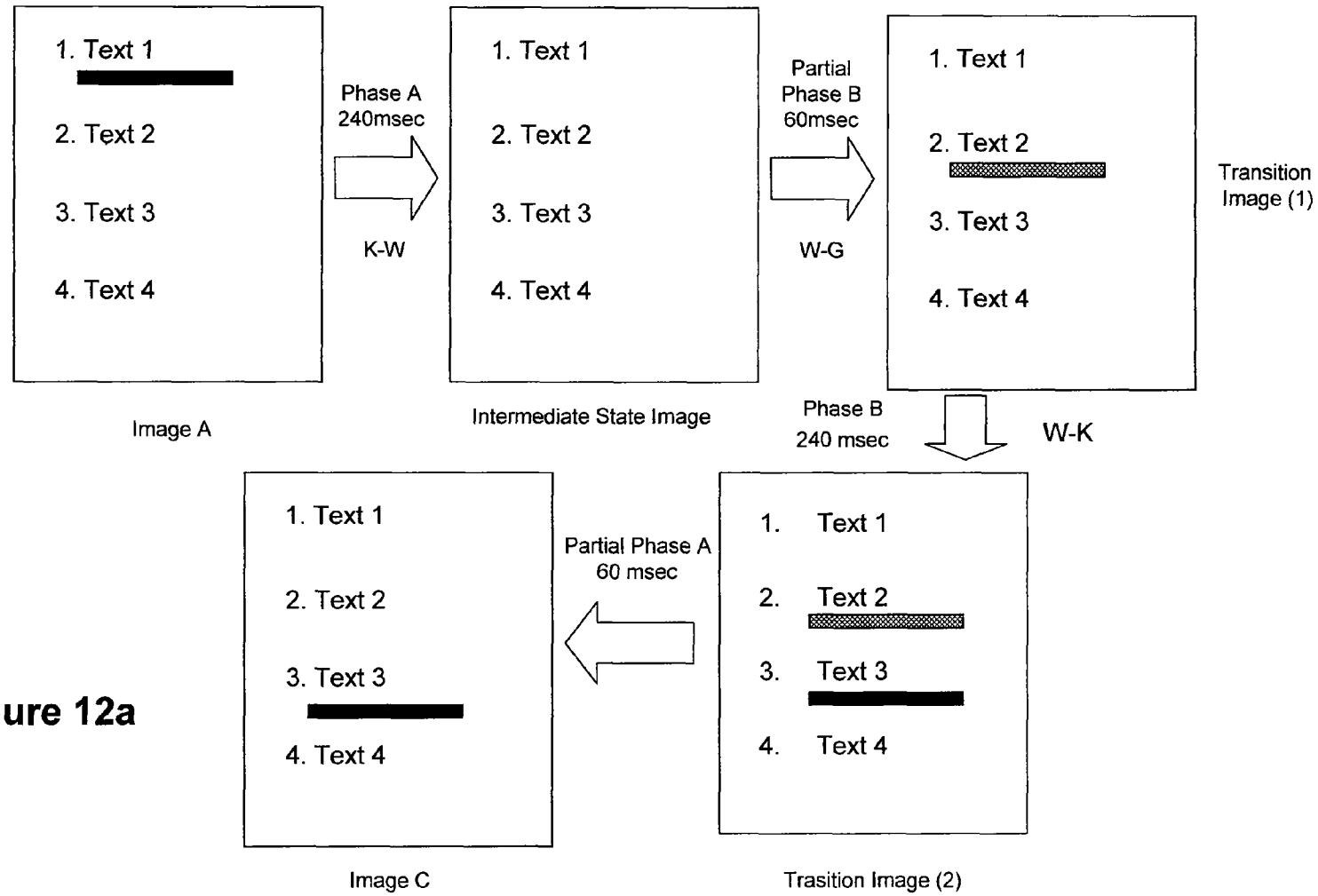
FIGS. 12*a*-12*c* illustrate an alternative driving sequence of FIGS. 9*a*-9*c*.
Figure 12B:
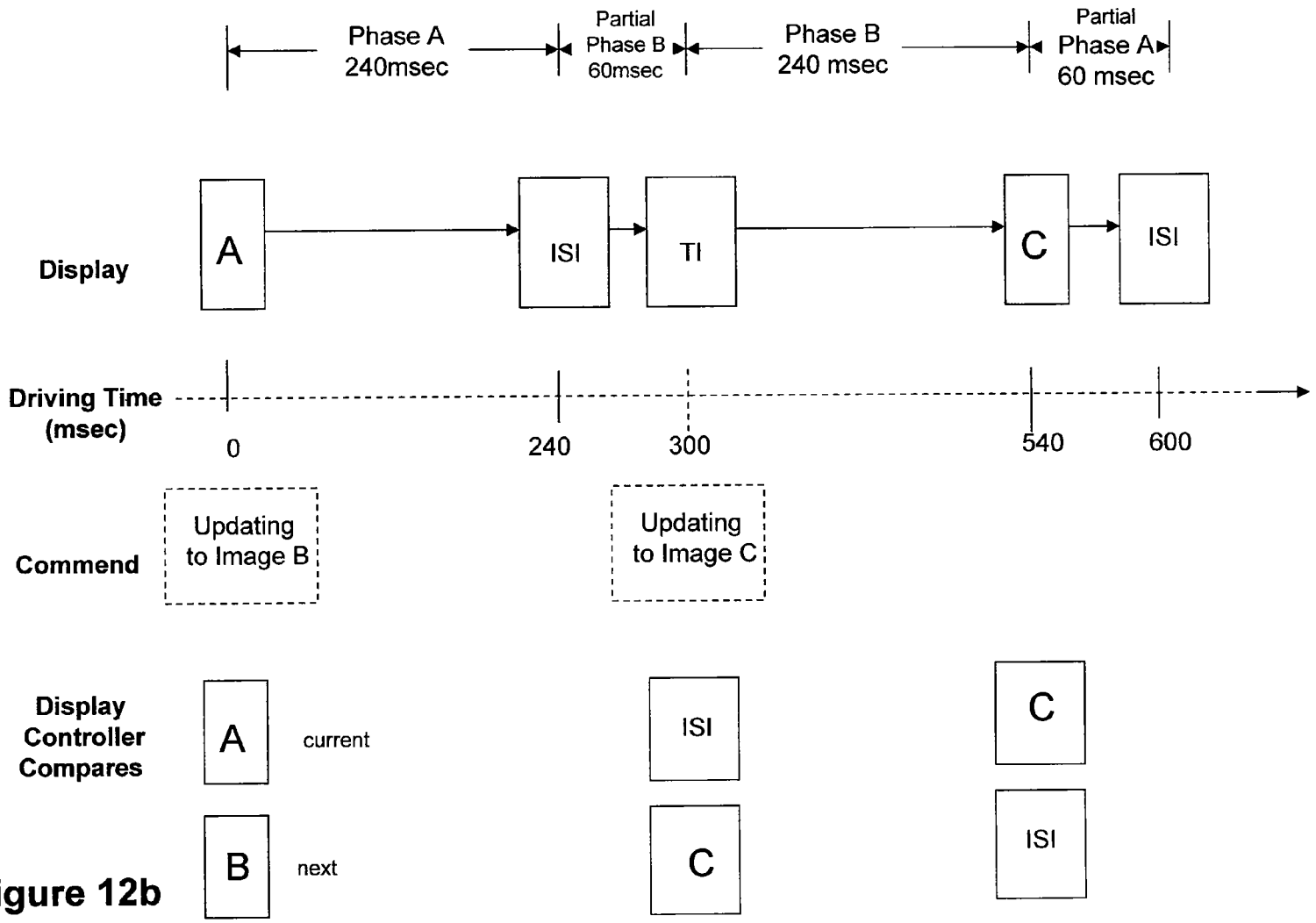
Figure 12C:
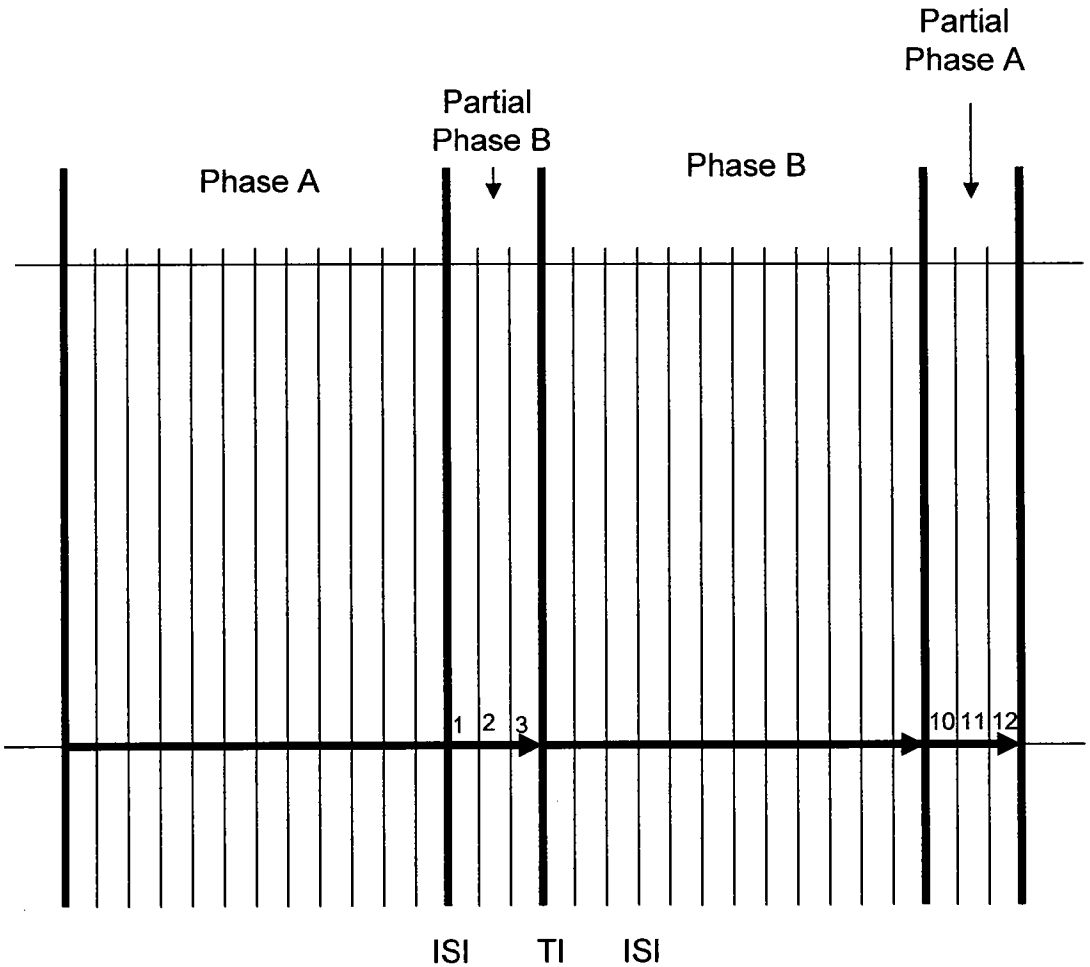

This example demonstrates an alternative of Example 3 and is illustrated by FIGS. 12*a*-12*c*.

As shown, the last two driving steps in Example 3 have been reversed in this example. The overall driving time is the same.

Although the foregoing disclosure has been described in some detail for purposes of clarity of understanding, it will be apparent to a person having ordinary skill in that art that certain changes and modifications may be practiced within the scope of the appended claims. It should be noted that there are many alternative ways of implementing both the method and system of the present invention. Accordingly, the present embodiments are to be considered as exemplary and not restrictive, and the inventive features are not to be limited to the details given herein, but may be modified within the scope and equivalents of the appended claims.

What is claimed is:

1. A driving method for continuously updating multiple images utilizing waveform phase A which drives pixels of a first color to a second color and waveform phase B which drives pixels of the second color to the first color, wherein each of phase A and phase B has N frames, and the method comprises:

a) completing a first phase A to update a current image to a first intermediate state image, in response to an initial command to update the current image to a first next image, wherein a first group of pixels in the first color is driven to the second color in the first intermediate state image;

b) partially completing a first phase B at frame n to update to a transition image, in response to a second command to update to a second next image, which command is received in the first phase B, wherein a second group of pixels in the second color is driven to an intermediate color state between the first color and the second color, in the transition image during the partial first phase B;

c) starting a partial second phase A at frame (N−n+1), and completing the partial second phase A to update to a second intermediate state image, wherein the partial first phase B and the partial second phase A have the same number of frames, wherein the second group of pixels in the intermediate color state is driven to the second color in the second intermediate state image during the partial second phase A; and d) completing a second phase B to update to the second next image, wherein a third group of pixels in the second color is driven to the first color in the second next image.

2. the of claim 1, wherein in step (a), a display controller, in response to the initial command to update the current image to the first next image, compares the current image and the first next image, finds proper waveforms to update the current image to the first next image.

3. The of claim 1, wherein in step (b), a display controller compares the first intermediate state image and the second next image, selects appropriate waveforms to update to the second next image.

4. The of claim 1, wherein there is only one interrupting command which is received in phase B.

5. The of claim 1, wherein there are more than one interrupting command received in phase B.

6. A driving method for continuously updating multiple images utilizing waveform phase A which drives pixels of a first color to a second color and waveform phase B which drives pixels of the second color to the first color, wherein each of phase A and phase B has N frames, and the method comprises:

a) completing a phase A to update a current image to a first intermediate state image, wherein a group of pixels in the first color is driven to the second color in the first intermediate state image;

b) partially completing a phase B at frame n to update to a transition image, in response to a subsequent command to update to a desired image, which command is received in the phase B, wherein a group of pixels in the second color is driven to an intermediate color state between the first color and the second color, in the transition image during the partial phase B;

c) starting a partial phase A at frame (N−n+1) to update to a subsequent intermediate state image, wherein the partial first phase B and the partial second phase A have the same number of frames, wherein a group of pixels in an intermediate color state is driven to the second color in the subsequent intermediate state image during the partial phase A; and d) completing a phase B to update to the desired image according to the subsequent command, wherein a group of pixels in the second color is driven to the first color in the desired image.

* * * * *